US011629004B2

(12) United States Patent
Christiansen

(10) Patent No.: US 11,629,004 B2
(45) Date of Patent: Apr. 18, 2023

(54) BEVERAGE CONTAINER HAVING A PRESSURE-RELIEF DEVICE AND A METHOD OF MANUFACTURING A BEVERAGE CONTAINER HAVING A PRESSURE-RELIEF DEVICE

(71) Applicant: CARLSBERG BREWERIES A/S, Copenhagen V (DK)

(72) Inventor: Jonas Christiansen, Copenhagen V (DK)

(73) Assignee: Carlsberg Breweries A/S, Copenhagen V (DK)

( * ) Notice: Subject to any disclaimer, the term of this patent is extended or adjusted under 35 U.S.C. 154(b) by 35 days.

(21) Appl. No.: 16/608,571

(22) PCT Filed: Apr. 19, 2018

(86) PCT No.: PCT/EP2018/060092
§ 371 (c)(1),
(2) Date: Oct. 25, 2019

(87) PCT Pub. No.: WO2018/197339
PCT Pub. Date: Nov. 1, 2018

(65) Prior Publication Data

US 2020/0180854 A1 Jun. 11, 2020

(30) Foreign Application Priority Data

Apr. 28, 2017 (EP) ..... 17168743
Aug. 10, 2017 (EP) ..... 17185765

(51) Int. Cl.
*B65D 85/72* (2006.01)
*B65D 51/16* (2006.01)
(Continued)

(52) U.S. Cl.
CPC ..... *B65D 85/72* (2013.01); *B65D 51/165* (2013.01); *B65D 51/1638* (2013.01);
(Continued)

(58) Field of Classification Search
CPC ..... B65D 85/72; B65D 51/1638; B65D 51/1644; B65D 51/165; B65D 17/4012;
(Continued)

(56) References Cited

U.S. PATENT DOCUMENTS 2,726,002 A * 12/1955 Dalianis ..... B65D 41/42 215/260
2,969,161 A 1/1961 McCulloch
(Continued)

FOREIGN PATENT DOCUMENTS

CN 2378333 Y 5/2000
CN 2579842 Y 10/2003
(Continued)

*Primary Examiner* — Rafael A Ortiz
*Assistant Examiner* — Sanjidul Islam
(74) *Attorney, Agent, or Firm* — BakerHostetler

(57) ABSTRACT

The present invention relates to a container assembly for accommodating a beverage. The container assembly comprises a collapsible beverage container having a body part for accommodating the beverage and a cylindrical neck part defining a gas-filled headspace. The container assembly further comprises a closure sealing off an opening of the cylindrical neck part. The closure comprises a closure disc, an inner cylindrical part and an outer cylindrical part. The closure disc comprises a beverage outlet for extracting the beverage. The closure further comprises a pressure-relief device located at the closure disc or the inner cylindrical part. The pressure-relief device is capable of establishing a permanent or reclosable opening through the closure or between the closure and the neck part for allowing a flow of fluid from the headspace to an external space when a
(Continued)

pressure difference exceeds a predetermined pressure value being lower than the burst pressure of the container.

11 Claims, 14 Drawing Sheets

(51) Int. Cl.
*B67D 1/12* (2006.01)
*B65D 17/28* (2006.01)
*A47G 19/22* (2006.01)

(52) U.S. Cl.
CPC ..... *B65D 51/1644* (2013.01); *B67D 1/125* (2013.01); *A47G 19/2272* (2013.01); *B65D 17/4012* (2018.01); *B65D 51/1661* (2013.01); *B65D 2205/02* (2013.01); *B65D 2543/00046* (2013.01)

(58) Field of Classification Search
CPC ..... B65D 51/1661; B65D 2205/02; B65D 2543/00046; B67D 1/125; A47G 19/2272
USPC ..... 215/260
See application file for complete search history.

(56) References Cited

U.S. PATENT DOCUMENTS

| | | | | |
|---|---|---|---|---|
| 5,433,242 | A | 7/1995 | Buchtel et al. | |
| 6,679,395 | B1 * | 1/2004 | Pfefferkorn | B65D 41/0421 215/252 |
| 9,016,333 | B2 | 4/2015 | Shaffer | |
| 2008/0078769 | A1 | 4/2008 | Crunkleton, III et al. | |
| 2015/0028052 | A1 * | 1/2015 | Rasmussen | B67D 1/0462 222/1 |
| 2016/0137478 | A1 | 5/2016 | Riis | |
| 2018/0118426 | A1 * | 5/2018 | Rasmussen | B65D 51/1661 |

FOREIGN PATENT DOCUMENTS

| | | | | | |
|---|---|---|---|---|---|
| CN | 103672062 | A | | 3/2014 | |
| EP | 1066215 | B1 | | 5/2006 | |
| EP | 2129616 | B1 | | 4/2016 | |
| FR | 3017605 | A1 | | 8/2019 | |
| GB | 2128967 | A | * | 5/1984 | B65D 51/1644 |
| JP | S442276 | Y1 | | 1/1969 | |
| JP | S51-048447 | A | | 4/1976 | |
| JP | 2007-537947 | A | | 12/2007 | |
| WO | 2016/169951 | A1 | | 10/2016 | |
| WO | WO-2016169951 | A1 | * | 10/2016 | B65D 1/023 |

* cited by examiner

BEVERAGE CONTAINER HAVING A PRESSURE-RELIEF DEVICE AND A METHOD OF MANUFACTURING A BEVERAGE CONTAINER HAVING A PRESSURE-RELIEF DEVICE

CROSS-REFERENCE TO RELATED APPLICATIONS

This application is the National Stage of International Patent Application No. PCT/EP2018/060092, filed Apr. 19, 2018, which claims the benefit of EP Patent Application No. 17168743.7, filed Apr. 28, 2017 and EP Patent Application No. 17185765.9, filed Aug. 10, 2017, the disclosures of each of which are incorporated herein by reference in their entireties for any and all purposes.

The present invention relates to a beverage container having a pressure-relief device and a method of manufacturing a beverage container having a pressure-relief device.

BACKGROUND

In the past, beverages have been transported from the place of production to the place of consumption in containers, such as bottles made of glass or alternatively in kegs made of wood or metal, preferably steel. Increasingly, new light and flexible materials such as plastic and preferably PET are used for transporting beverage replacing both glass bottles and metal and wooded containers.

One advantage of using plastic containers instead of glass, metal or wooden containers is the significantly less weight of plastic containers, Another advantage of using plastic containers is the fact that such containers are flexible and may be blow-molded out of small preforms just before filling the beverage. After the container has been emptied of beverage at the place of consumption, the beverage container may be collapsed, i.e. compressed or compacted, to a much smaller size compared to the originally filled size. Many modern beverage dispensing systems compress the containers even during tapping. Also, using a modern beverage dispensing system may eliminate any contact between the user and the beverage.

Yet further, the plastic containers may be recycled in an environmentally friendly way either by melting in order to re-use the raw material, or by combustion resulting—apart from generation of carbon dioxide and water—in the recovery of energy. Containers made of glass, metal or wood are more difficult to recycle and typically must be transported back to the beverage producer for cleaning or alternatively to the manufacturer for being melted down under high temperature and re-used as raw material, both options resulting in environmental impact in the form of energy use and possible use of toxic substances.

In order to save on material and allow the container to be easily collapsible, it is desirable to use as thin-walled containers as possible, Storing pressurized beverages, such as carbonated beverage, in thin-walled containers will on the other hand increase the risk of rupturing the container. A rupture may in addition to the complete loss of the beverage stored in the container also result in personal injury or damage on property due to debris from the rupturing container. Ruptures may occur due to accidental piercing of the container, however, the most violent ruptures may be caused by an increase of the pressure inside the container.

As the pressure inside the container is directly dependent on the temperature of the beverage, rupture may occur as a result of a fire close to the location of the container or by leaving the container in a hot location such as in direct sunlight or inside an enclosed space which is being heated by sunlight. Further, fermented beverages such as beer release a large amount of carbon dioxide during the fermentation. When the beverage has been sealed in the container, the fermentation should have stopped or at least not continue in an uncontrolled or unpredictable way. In case the fermentation continues in an uncontrolled way when the beverage has been sealed within the container, the pressure increase caused by the gas produced during the uncontrolled fermentation may cause the container to rupture. Thus, there is a need to make such containers pressure safe.

Ruptures due to pressure increase within the container may be avoided by the use of an overpressure valve, which may limit the pressure within the beverage container by opening at a certain pressure limit and relieving the inner space of the beverage container of any excessive pressure. However, any additional parts will increase the overall complexity and overall cost of the beverage container. As beverage containers are produced in very high numbers, it is necessary to keep the costs as low as possible.

It is therefore an object according to the present invention to provide technologies for avoiding overpressure related rupture of beverage containers while keeping the additional cost per unit low.

PRIOR ART

US 2008/0078769 A1 discloses a high-pressure gas cylinder comprising a neck having an elongated throat and a mouth at an outer end of the throat. A plug and a piercable membrane are positioned within the throat at a substantial distance from the mouth. The high-pressure gas cylinder further comprises a shipping cap removably mounted on the neck. The shipping cap includes at least two gas vent ports extending radially outwardly through the cap.

If the seal provided by the plug is breached, compressed gas exiting the gas cylinder through the throat exits the cap through the opposed radial vent ports. Because the vent ports are substantially identically configured, escaping gas will exit each of the vent ports at substantially equal flow volumes and exit velocities. Accordingly, the vents of the shipping cap prevent a breached bottle assembly from becoming a missile.

CN 2378333Y relates to a beer bottle washer made of plastic. The plastic washer is pressed elastically between the bottle mouth and cap. When the pressure inside the bottle increases to near a rupture critical pressure, the plastic washer loosens microscopically and part of the gas within the bottle may be released in order to reduce the rupture probability.

WO 2016/169951 A1, assigned to the applicant company, relates to a very simple and efficient way of including a safety valve in a beverage container by having a flexible sealing ring compressed between the closure and the neck of the container. The sealing ring is movable to a second position in which a larger part of the sealing ring is compressed between the closure and the neck of the container and smaller part of said sealing ring uncompressed within a groove allowing fluid communication between the gas-filled headspace and the exterior of the beverage container. The above system allows for degassing of the headspace in case the pressure increases, however, there is a risk that the sealing ring return to its original position once the overpressure is released which makes it difficult for the user to detect whether the situation in which the pressure increases has occurred or not. Further, is it difficult to accurately define the critical pressure at which the sealing ring moves to the second position as the critical pressure is not directly depending on the pressure difference between the inside and the outside of the beverage container but on the elasticity of the sealing ring. This elasticity of the sealing ring is dependent on various non-pressure dependent factors, such as temperature.

EP 1066215 B1 relates to a safety blow-out device specifically adapted for use with a spear fitted to a keg. The safety blow-out device comprises a resiliently deformable member comprising a substantially annular end portion having an aperture through which an inner tube of the spear is passed in use and a plurality of legs extending from the end portion generally upwardly or towards the neck of the keg in use.

U.S. Pat. No. 2,969,161 A relates to a bung for beer barrels and the like comprising a partially fracturable cap secured to the inner end of said connector tube and normally sealing in the contents of the barrel. Upon insertion of a tap fitting through the connector tube against the cap, the latter will partially break away from the tube to an extent sufficient to permit passage of a fitting into the interior of the barrel for dispensing the contents thereof.

EP 2129616 B1 relates to a diaphragm for use in a valve assembly and comprising at least one sealing portion and a fixation portion. The fixation portion and the at least one sealing portion are connected by a flexible portion.

US 2016137478 A1 relates to an extractor tube assembly for a beverage container comprising a gas valve and a beverage valve adapted to cooperate with each other and comprising a ring-shaped gasket. The gasket is made of an elastomeric material and comprises an insert made of a rigid material. The elastomeric material encloses the insert and a portion of the top part of the gasket is adapted to be released from the insert when a pressure inside the beverage container exceeds a predetermined level so that fluid communication between an interior of the beverage container and the surroundings is provided and pressure is released from the beverage container. The gasket further comprises an identification detectable from the upper face of the gasket so that it is easily detectable if a pressure release function of the gasket has been partly or fully initiated.

U.S. Pat. No. 9,016,333 B2 relates to a fluid dispensing system comprising a container having a one-way valve received within the container wall. The one-way valve may be a flexible member made from any suitable material, such as silicone, and configured for opening to allow fluid to flow from an outlet port of the valve body through aperture of the container. The one-way valve may be a duckbill valve that defines a slot created by the edges of a flexible member. A flow of fluid through the outlet port opens the flexible member and slot to allow a flow of fluid into the container. When fluid is not exiting the outlet port, the slot closes as the edges of the flexible member collapse onto each other to form a seal.

U.S. Pat. No. 5,433,242 A relates to a valve structure or assembly including a tank valve base, a duckbill valve retainer, a duckbill valve, a poppet valve stem, urging spring and a valve body.

SUMMARY OF THE INVENTION

At least the above advantage, need and object or at least one of numerous further advantages, needs and objects, which will be evident from the below description of the present invention, is according to a first aspect of the present invention obtained by container assembly for accommodating a beverage, the container assembly comprising:

a collapsible beverage container having a body part defining an inner volume for accommodating the beverage and a cylindrical neck part defining a gas-filled headspace, the cylindrical neck part further defining an opening, an inwardly oriented surface and an outwardly oriented surface, the beverage container further defining a burst pressure, and a closure sealing off the opening of the cylindrical neck part and comprising a closure disc facing the headspace of the collapsible beverage container, an inner cylindrical part facing the inwardly oriented surface of the cylindrical neck part and an outer cylindrical part facing the outwardly oriented surface of the cylindrical neck part, the closure disc comprising a beverage outlet for extracting the beverage from the beverage container, the closure further comprising a pressure-relief device located at the closure disc or the inner cylindrical part, the pressure-relief device being capable of establishing a permanent or reclosable opening through the closure or between the closure and the neck part for allowing a flow of fluid from the headspace of the collapsible beverage container to an external space when a pressure difference between the headspace and the external space exceeds a predetermined pressure value, the predetermined pressure value being lower than the burst pressure.

The beverage container is preferably blow-molded in a light and flexible polymeric material, which is self-supporting and capable of accommodating a carbonated beverage held, closed off from the environment at an internal pressure. Once the container is opened, the beverage container is capable of collapsing when a pressure is applied from the outside, which is greater than the internal pressure. The material may be e.g. PET, PE, PP. The container is preferably provided in the form of a pre-form, which is blow-moulded to its filling size just before being filled at the brewery.

The beverage container typically has a bottle shape, i.e. a larger body portion for accommodating all or most of the beverage, and a cylindrical neck part having an opening which forms a beverage outlet and which is closed off by the closure. The closure is permanently fastened to the neck part of the beverage container once the beverage container has been filled. The purpose of the closure is primarily to seal off the opening of the beverage container in a pressure-tight way and enabling a beverage outlet for extracting the beverage. The beverage outlet is sealed off during transport and handling and is opened for dispensing the beverage, typically when installing the beverage container in the beverage dispensing system. It may optionally include a one-way valve. The beverage outlet is preferably centrally located in the closure disc of the closure. In some embodiments, the closure is also used for providing a base plate for installing and sealing the beverage container inside the pressure chamber of the beverage dispensing system.

The inner cylindrical part and the outer cylindrical part are used for fastening and sealing the closure to the neck part of the beverage container. Preferably, the inner cylindrical part seals against the inwardly oriented surface of the neck, whereas the outer cylindrical part is fastened to the outwardly oriented surface of the neck. The fastening may be by means of a press fit, locking mechanism, click fit, welding, screw fit or any other technology, which is considered safe for food products. The sealing may be made by an elastomeric material such as a sealing ring. The provision of an inner cylindrical part and an outer cylindrical part allows the closure disc to be protected, since the closure disc may be located inside the neck part of the beverage container. The inner cylindrical part and the outer cylindrical part will thus act as flanges for protecting the closure disc including the beverage outlet.

The pressure-relief device is provided as a safety device in case the pressure inside the beverage container increases to a level, which may cause the beverage container to rupture or deform. The pressure-relief device provides a predetermined location at which an overpressure may be released, thus preventing an uncontrolled rupture or explosion, which may cause damage to property or seriously injure persons in the vicinity of the beverage container. An increase in pressure may be caused e.g. by an increase in temperature inside the beverage container or by an uncontrolled fermentation inside the container.

When the pressure relief device opens, fluid will escape though the opening from the beverage container and thereby the pressure inside the beverage container will be reduced. Depending on the orientation of the beverage container, either gas or beverage (liquid) will be vented though the opening. The pressure relief device typically forms part of the closure disc or the inner cylindrical part and may completely or to a substantial part be made of the same material as the closure disc and the inner cylindrical part. The use of the closure disc or the inner cylindrical part allows the pressure relief device to be independent from the beverage container while allowing the pressure relief device to be directly in contact with the interior of the beverage container. This will ensure that the pressure relief device is directly exposed to the pressure inside the beverage container.

The pressure-relief device is preferably located on the closure adjacent the beverage outlet or on the inner cylindrical part such that the pressure-relief device is protected the same way as the beverage outlet, i.e. avoiding that the user opens the pressure-relief device by mistake during handling and transport. Alternatively, it may also be located between the closure and the neck part, or directly in the sealing part of the closure Preferably, the pressure-relief device will still be operable and facing the outside of when the container is inside the pressure chamber. Thus, in case of an overpressure in the container inside the pressure chamber for any of the above reasons or due to a malfunction of the pressure chamber, the pressure-relief device will open and depressurize the entire pressure chamber and avoid a possible rupture of the pressure chamber. The position of the pressure-relief device on the closure will also reduce the effect of a malfunction of the pressure-relief device itself, i.e. in case the pressure-relief device fragments, most of the fragments will be contained in the space within the inner cylindrical part or the closure and not hurdled towards the user.

The pressure-relief device has a predetermined opening pressure and once opened, the pressure-relief device forms a permanent opening for venting the entire overpressure in the container to the outside, or alternatively a reclosable opening which may close once a sufficient amount of fluid has been vented. The opening should be formed in a controlled way, i.e. without forming fragments, which may cause damage. The pressure-relief device is thus typically made of a flexible but non-elastic material, which opens and stays open, once the relative pressure between the inside of the container and the outside exceeds the predetermined breaking pressure.

The predetermined opening pressure is chosen to be a pressure, which is higher than the pressures, which normally occur in the beverage container due to the internal pressurization at standard environmental pressures and temperatures, but lower than a maximum safe pressure of the beverage container. The maximum safe pressure of the beverage container is in turn dependent on the thickness and material properties of the container walls, and it is evident that the walls will have a thickness which allows the beverage container to be as light as possible while still being able to survive normal handling.

The opening may preferably be permanent, meaning that the pressure-relief device stays open, i.e. it is non-resilient. Thus, the pressure-relief device does not reclose again when the pressure within the beverage container has been reduced, and remains open even when the pressure within the beverage container has been equalized with the pressure outside the beverage container, i.e. atmospheric pressure. Consequently, the user will easily detect that the pressure-relief device has been activated either visually or by realizing that the beverage container will be much more easily compressed by e.g. the hand of the user when the pressure-relief device is open compared to when the pressure-relief device is closed and the beverage container is pressurized. When the pressure-relief device is open, it is essentially only the flexibility and thickness of the beverage container that provide resistance, whereas a filled and closed off beverage container will allow only a small amount of compression as the liquid is essentially non-compressible and the headspace is pressurized. Thus, there is no risk that the user consumes a beverage, which is not suitable for drinking.

Alternatively, the opening is reclosable, typically by providing the pressure relief device with a resilient material, which automatically closes the opening when the pressure inside the beverage container has been reduced, i.e. when a sufficient amount of fluid has been vented.

According to a further embodiment, the pressure relief device being at least partially visible from outside the container assembly. In this way, it will be easier for the user to detect whether or not the pressure relief device has been activated.

According to a further embodiment, the pressure-relief device comprises a weakened part of the inner cylindrical part, the weakened part deforms permanently and/or resiliently inwardly when the pressure difference between the headspace and the external space exceeds the predetermined pressure value, thereby establishing the opening, i.e. the permanent or reclosable opening. When the inner cylindrical part seals against the neck part of the container, the inner cylindrical part may comprise a section which is weakened by e.g. being thinner than the surrounding parts and when a high differential pressure exists between the inside and the outside of the beverage container, the weakened section will bulge inwardly compromising the seal and allow gas to pass between the neck and the closure. The weakened part is typically non-elastomeric and will thus not resume its original shape when the pressure is equalized, however, it may also be at least partially elastomeric such that it resumes its original shape when the pressure inside the beverage container is lower. Combinations of permanent and resilient deformations are contemplated, i.e. that some but not all of the deformation is restored when the pressure is lowered.

According to a further embodiment, the pressure-relief device comprises an elastomeric sealing ring disposed between the inner cylindrical part of the closure and the inwardly oriented surface of the cylindrical neck part, the weakened part of the inner cylindrical part and the elastomeric sealing ring optionally constitutes an integral part. When the weakened part deforms inwardly, the elastomeric ring may displace into the bulge for compromising the sealing properties between the closure and the neck. Having the weakened part of the inner cylindrical part and the elastomeric sealing ring constituting an integral part, the assembly of the sealing ring and the closure will be simplified.

According to a further embodiment, the pressure-relief device comprises an elongated hollow protrusion extending outwardly from the closure disc and having a predetermined breaking point at a distant end of the elongated hollow protrusion for establishing a permanent opening when the pressure difference between the headspace and the external space exceeds the predetermined pressure value. The elevated pressure acts on the inside of the hollow protrusion and once the pressure difference, and the associated pressure force is sufficiently high, the predetermined breaking point opens and releases the overpressure in the beverage container. The protrusion typically opens forming two or more wall parts that extend from the closure disc. Even in the unlikely event that the wall parts separate from the outer face, the wall parts will not be hurled against the user but instead sidewards. The opening, which is established thereby, will be permanent.

The above embodiment of the pressure-relief device resembles a duckbill valve with some exceptions. A duckbill valve is a type of one-way valve that resembles a duckbill. However, whereas the typical duckbill valve is of a resilient nature and recloses after the pressure difference is equalized, the present pressure-relief device is made of a substantially non-resilient material and remains open once the predetermined breaking point opens. Further, in the typical duckbill valve, the predetermined breaking point is in fact open and sealed simply by the resilience of the material of the valve; whereas in the present case, the predetermined breaking point is a closed off but weakened portion of the wall.

According to a further embodiment, the pressure-relief device comprises a burst plate located in the closure disc for establishing a permanent opening when the pressure difference between the headspace and the external space exceeds the predetermined pressure value. In the simplest realization, a burst plate may be provided which has the predetermined breaking point and which establishes an opening that is permanent when the pressure difference exceeds the predetermined breaking pressure. The burst plate may be a disk having a weakened part in the form of scores or the like.

According to a further embodiment, the pressure-relief device comprises:

- a flexible foil located at the closure disc facing the headspace of the beverage container and covering an aperture of the closure disc,
- a piercing mechanism located between the flexible foil and the aperture and facing the flexible foil, and
- a movable plate located in a first position between the flexible foil and the piercing mechanism for supporting the flexible foil, the movable plate being permanently movable to a second position distant from the flexible foil when the pressure difference between the headspace and the external space exceeds the predetermined pressure value allowing the flexible foil to contact the piercing mechanism thereby breaking the flexible foil and establishing the opening.

The pressure-relief device is thus located entirely below the outer face of the closure disc. The only visible part of the pressure-relief device is the aperture. This essentially eliminates the risks that the user activates and opens the pressure-relief device by mistake and/or that the user is injured by fragments of a malfunctioning pressure release device. The flexible foil may be e.g. made of aluminum or similar thin and flexible material. The piercing mechanism is typically made of plastic or similar material and should be capable of piercing the flexible foil upon contact.

Under normal pressure conditions, i.e. the movable plate being in the first position, the piercing mechanism will not contact the flexible foil as the movable plate will prevent any contact. In case of a potentially dangerous overpressure situation inside the beverage container, the movable plate moves away to the second position in order for the foil to be able to deform towards the piercing mechanism due to the pressure difference. As the foil contacts the piercing mechanism, an opening will form, which will allow gas to escape and thus reduce the pressure in the beverage container. The opening is permanent, and thus the pressure inside the beverage container will equalize to the outside pressure. The predetermined breaking point is a position on the foil, which the piercing mechanism contacts; however, it must not necessarily be weaker than the rest of the foil as the piercing mechanism performs the breaking.

The flexible foil seals off the aperture of the closure disc and is as such exposed to the pressure difference between the inside of the beverage container and the outside. The movable plate is initially placed in a releasable position between the flexible foil and the piercing mechanism and supports the foil such that the foil is prevented from bending or flexing towards the outside and the piercing mechanism due to the pressure difference. The movable plate is releasable when it is exposed to a pressure force, which exceeds the predetermined breaking pressure. The movable plate may e.g. be positioned in the first position by an interference fit or the like. This allows for a very accurate release of the overpressure in the container.

According to a further embodiment, the piercing mechanism is hollow. According to one preferred embodiment, the piercing mechanism also contains an aperture through the closure disc. In this way, when the flexible foil is pierced, a direct channel is established, which cannot be obstructed between the inside of the beverage container and the outside.

According to a further embodiment, the piercing mechanism forms part of the movable plate. The piercing mechanism may e.g. be part of a resilient section of the movable plate. By combining the piercing mechanism and the movable plate, the manufacturing and installation of the closure plate (closure) will be simplified as the movable plate itself may be a standard component and the combined movable plate and piercing mechanism provided separately and installed in one single operation.

According to a further embodiment, the movable plate is ring-shaped and optionally includes an auxiliary aperture for accommodating the piercing mechanism. By making the movable plate ring-shaped, it will be easier to install since it is symmetric. The auxiliary apertures accommodate the piercing mechanism and when the plate is in the first position, the piercing mechanism is completely covered by the bore of the aperture, whereas when the movable plate moves to the second position, the piercing mechanism protrudes from the bore and pierces the flexible foil which unsupported by the plate deforms and becomes pierced by the piercing mechanism.

According to a further embodiment, the movable plate is snap fitted or spring fitted to the closure plate. Snap fits and spring fits are two alternatives to interference fits, which allow a very accurate activation of the movable plate to move from the first position to the second position at the predetermined breaking pressure. Snap fit is construed to involve two interlocking parts, which at the predetermined breaking pressure are forced apart. The spring fit may be made using a flexible part of the plate resting against the closure plate.

According to a further embodiment, the flexible foil covers the beverage outlet. The same flexible foil may also be used for covering the beverage outlet allowing this part to have a dual purpose. It is thus—in addition to providing the breakable element of the pressure-relief device—used for sealing off the beverage container during transport and storage. When the beverage container is used, e.g. installed in the beverage dispensing system, the flexible foil is broken at the location of the beverage outlet, but remains intact at the location of the pressure-relief device maintaining its function.

According to a further embodiment, the closure disc comprises a valve seat and the pressure-relief device comprises valve body urged against the valve seat by a spring. A spring-loaded valve may be preferred since its behavior may be accurately predicted due to the high predictability of springs in contrast to predetermined breaking points those breaking pressure cannot be predicted with equal high accuracy.

According to a further embodiment, the pressure-relief device comprises a housing for accommodating the valve body and the spring, the housing preferably including a slot opening, the housing optionally including a guide hole for guiding a guide part of the valve body, the guide part optionally being flexible and optionally including a stopper. These features allow the spring-loaded valve to operate with higher reliability.

According to a further embodiment, the beverage comprises dissolved $CO_2$ and/or $N_2$, the beverage establishing a temperature dependent pressurization inside the beverage container, the temperature dependent pressurization being lower than the burst pressure at room temperature.

As used herein, room temperature means between 0° C. and 60° C., preferably between 10° C. and 40° C., more preferably between 15° C. and 30° C., most preferably between 20° C. and 25° C., such as 22° C.

According to a further embodiment, the pressure-relief device comprises a plurality of piercing elements circumferentially disposed about the beverage outlet, preferably 2-20, more preferably 3-15, such as 4-10. In order to make the pressure-relief device fail-safe and to allow a quicker depressurization of the beverage container, a plurality of piercing mechanisms may be used yielding a plurality of openings when the movable plate is in the second position. The flexible foil is consequently broken at a plurality of locations when the pressure difference exceeds the predetermined breaking pressure. Correspondingly, there may be provided a plurality of apertures as well, but not necessarily the same plurality.

According to a further embodiment, the beverage outlet comprises a one-way valve. The one-way valve preferably allows fluid to flow from the beverage container to the outside, but not the other way. In this way, the beverage may not be forced into the container.

According to a further embodiment, the beverage outlet comprises a connector extending outwardly from the outer face and circumferentially enclosing the beverage outlet, the pressure-relief device being positioned between the connector and the outer circumferential flange. In this way, a connector is provided for connecting the beverage container to a dispensing line and a further flange for protecting the pressure-relief device.

According to a further embodiment, the predetermined breaking pressure is between 3 atm and 15 atm, preferably between 5 atm and 10 atm, more preferably between 7 atm and 8 atm. The above pressures are suitable maximum pressures for the beverage container as the normal internal pressure in the beverage at standard temperatures is about 2-3 atm above atmospheric pressure.

At least the above advantage, need and object or at least one of numerous further advantages, needs and objects, which will be evident from the below description of the present invention, is according to a second aspect of the present invention obtained by a beverage dispensing system comprising a pressure chamber, a flexible and collapsible beverage container according to any of the previous embodiments for being positioned in the pressure chamber, and a lid for closing the pressure chamber and sealing against the flange of the closure plate of the beverage container, the beverage dispensing system further comprising a beverage tap for dispensing the beverage, a keg connector for being connected to the beverage outlet of the beverage container, and a tapping line extending between the beverage tap and the keg connector.

At the point of consumption, e.g. a bar, restaurant or the like, the beverage container is positioned in a pressure chamber and the beverage is urged from the beverage container by applying an overpressure inside the pressure chamber. The overpressure typically corresponds to the internal pressure of the beverage, e.g. about 2-3 atm above atmospheric. The lid of the pressure chamber is used to close off the pressure chamber and seals against the flange of the closure plate of the beverage container, such that the beverage outlet faces atmospheric pressure. By connecting the keg connector to the beverage outlet and operating the beverage tap, the beverage is forced from the container to the tap while the container is compressed. In case an overpressure occurs, which may be considered dangerous, the pressure-relief device is still operational and will provide an opening between the beverage container and the outside.

At least the above advantage, need and object or at least one of numerous further advantages, needs and objects, which will be evident from the below description of the present invention, is according to a third aspect of the present invention obtained by method of filling and handling a beverage container comprising:

providing a collapsible beverage container having a body part defining an inner volume and a cylindrical neck part defining a gas-filled headspace, the cylindrical neck part further defining an opening, an inwardly oriented surface and an outwardly oriented surface, the beverage container further defining a burst pressure, accommodating a beverage in the inner volume of the beverage container, sealing off the opening of the cylindrical neck part by a closure comprising a closure disc facing the headspace of the collapsible beverage container, an inner cylindrical part facing the inwardly oriented surface of the cylindrical neck part and an outer cylindrical part facing the outwardly oriented surface of the cylindrical neck part, the closure disc comprising a beverage outlet for extracting the beverage from the beverage container and a pressure relief device located at the closure disc or the inner cylindrical part, and causing a pressure difference between the headspace and an external space to exceed a predetermined pressure value, thereby establishing a permanent or reclosable opening through the closure or between the closure and the neck part by the pressure-relief device for allowing a flow of fluid from the headspace of the collapsible beverage container to the external space, the predetermined pressure value being lower than the burst pressure.

The above method according to the third aspect may be used together with the beverage dispensing system according to the second aspect and/or the container assembly according to the first aspect. The method describes the application of the closure plate on the beverage container.

BRIEF DESCRIPTION OF THE DRAWINGS

FIG. 6D1&2 is a close-up of the pressure-relief device when under pressure FIG. 6E1&2 is a close-up of the pressure-relief device when open FIG. 6F1&2 is a close-up of the pressure-relief device when open

DETAILED DESCRIPTION OF THE DRAWINGS

Figure 1A:
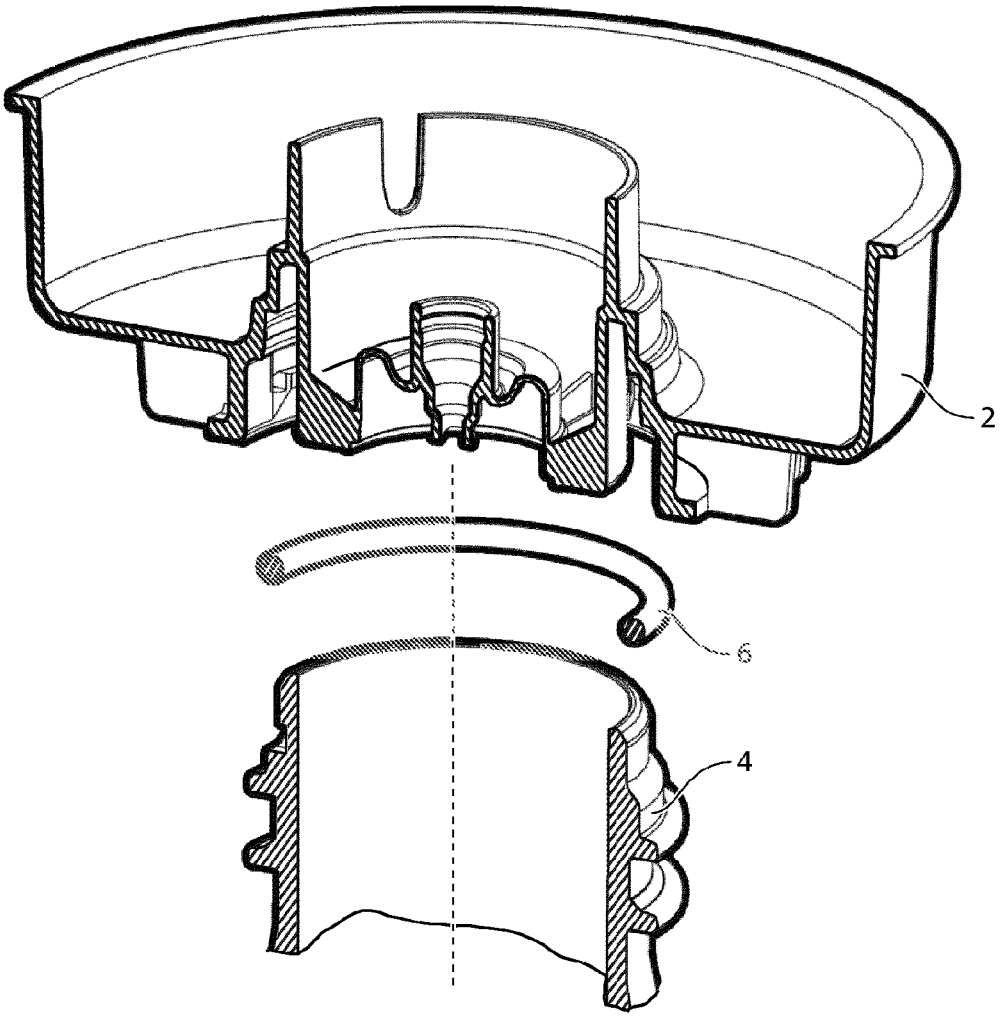
FIG. 1A is a non-assembled container assembly according to the prior art

FIG. 1A shows a perspective cut view of non-assembled container assembly according to the prior art including a closure 2. The closure 2 illustrated here is of the type used for larger containers of about 5 liters and more. The beverage container comprises a neck part 4 defining a gas-filled headspace and a body part (not shown) typically filled by carbonated beverage. The assembly comprising the beverage container and the closure 2 further comprises a sealing ring 6.

Figure 1B:
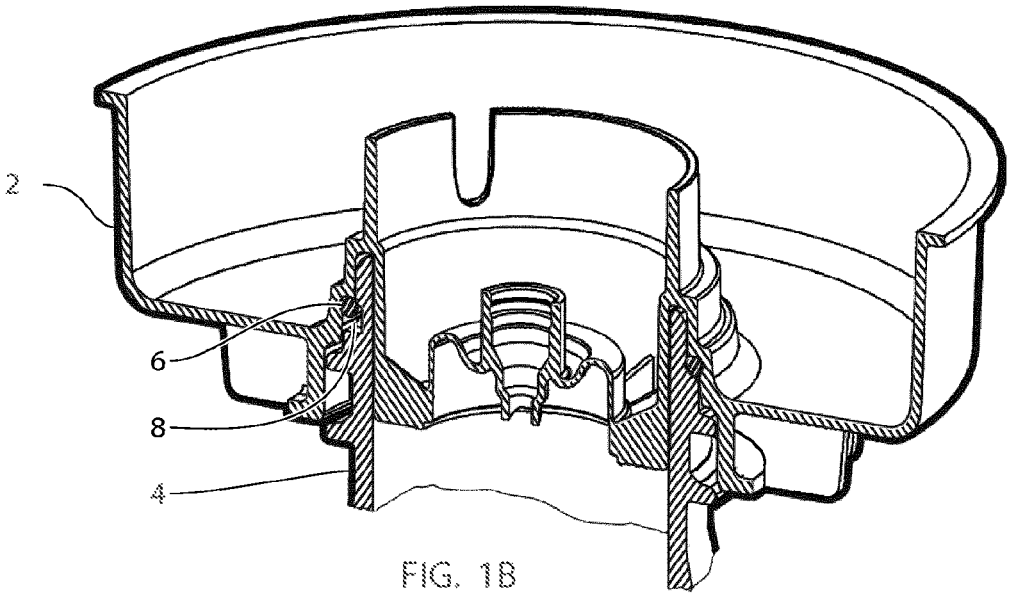
FIG. 1B is an assembled container assembly according to the prior art

FIG. 1B shows an assembled container assembly according to the prior art. The sealing ring 6 is compressed or squeezed in a circumferential cavity established between the closure 2 and the neck part 4. A pressure-tight sealing is thereby achieved by the elastic compression of the sealing ring 6 against the surfaces establishing the above-mentioned cavity.

The neck part 4 defines a groove 8, which occupies a smaller part of the circumference defined by the neck part 4. When the pressure inside the beverage container is elevated above the equilibrium pressure of the carbonated beverage at room temperature, e.g. by elevating the temperature of the beverage, approaching the burst pressure of the beverage container, the increased pressure causes the sealing ring 6 to elastically deform and stretch at the location of the groove 8 so that the sealing ring 6, at the location of the groove 8, will move into the groove 8. The lack of sealing pressure between the neck part 4 at the location of the groove 8 will allow some gas from the headspace to escape from the inside of the beverage container to the exterior of the beverage container When the pressure inside the beverage container is reduced to a safe level, the elastomeric sealing ring 6 should preferably not resume the position compressed between the closure 2 and the neck part 4 but maintain the uncompressed position within the groove 8. In this way it may be established whether or not the container has been subjected to a pressure increase caused by e.g. high temperatures or uncontrolled fermentation. However, in practice it has been noted that since there is nothing preventing the sealing ring from resuming the sealed position instead of a one-way function of the sealing ring, it is more or less occasional whether the sealing ring stays in the open position or resumes the closed position when the pressure is reduced.

Figures 2A, 2B, 2C, 2D:
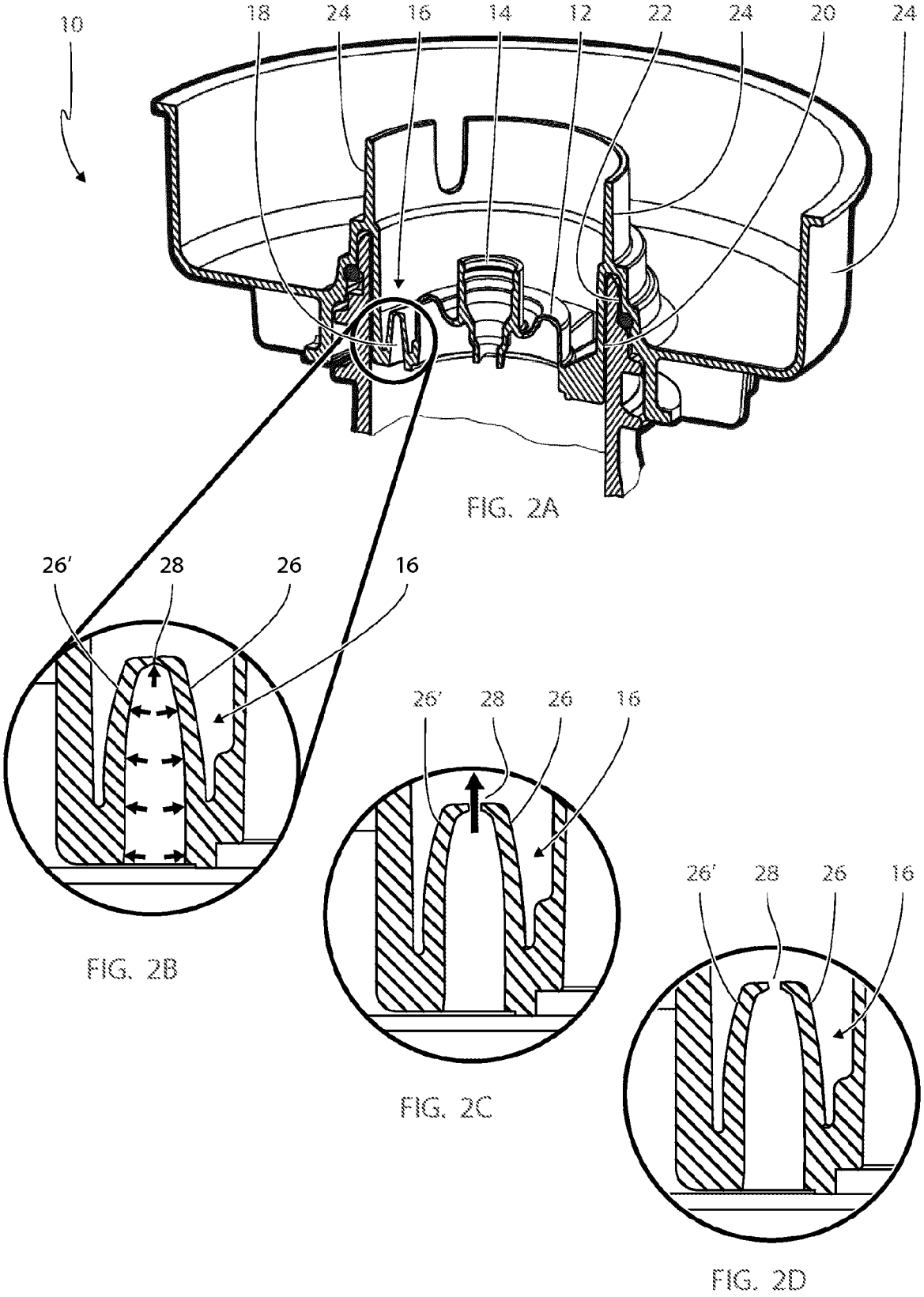
FIG. 2A is a closure having an outwardly oriented protrusion
FIG. 2B is a close-up of the outwardly oriented protrusion when under pressure
FIG. 2C is a close-up of the outwardly oriented protrusion when open
FIG. 2D is a close-up of the outwardly oriented protrusion when open

FIG. 2A shows a closure 10 forming part of a container assembly according to the present invention. The closure 10 is made of rigid plastic such as PE or PET and comprises a closure disc 12 including a centrally located beverage outlet 14. The closure disc is intended to face a gas-filled headspace (not shown) of the neck part of the beverage container. The closure disc further comprises a pressure-relief device 16 in the form of a hollow protrusion 18 extending outwardly from the closure disc 12.

The closure 10 further comprises an inner cylindrical part 20 being integrally joined to the closure disc 12 and an outer cylindrical part 22 being integrally joined to the inner cylindrical part 20. The inner cylindrical part 20 and the outer cylindrical part 22 are intended to arrest and seal against the neck part (not shown) of the beverage container. The closure 12 is provided with optional auxiliary flanges 24 for protecting the beverage outlet 14 and the pressure-relief valve 16, for sealing against a beverage dispensing system and for simplifying handling.

FIG. 2B shows a close-up of the outwardly oriented protrusion 18 when closed and under pressure which pressure force is indicated by the arrows. The outwardly oriented protrusion essentially comprises outwardly oriented wall parts 26 $\mathbf{26^I}$ which together form a predetermined breaking point 28 at a distant location. As can be seen, the pressure force acts forcing the outwardly oriented wall parts 26 $\mathbf{26^I}$ apart. The outwardly oriented wall parts 26 are held together by predetermined breaking point 28. As long as the internal carbonization pressure of the beverage is lower than the predetermined pressure value at which the predetermined breaking point 28 breaks, the pressure-relief device 16 will not open. The predetermined pressure value should be chosen to be significantly higher than the internal carbonization pressure at room temperature but significantly lower than the burst pressure of the beverage container. The burst pressure of the container is the expected differential pressure allowed before the container bursts.

FIG. 2C shows a close-up of the outwardly oriented protrusion when open. When the internal pressure of the beverage container exceeds the predetermined pressure value, the predetermined breaking point 28 will break and the wall parts 26 $\mathbf{26^I}$ will be forced apart and create an opening in place of the predetermined breaking point 28. Then gas in the headspace of the beverage container will flow out of the opening as shown by the arrow.

FIG. 2D shows a close-up of the outwardly oriented protrusion 18 when open. The wall parts 26 $\mathbf{26^I}$ will plastically deform such that the opening remains even when the pressure inside the beverage container is substantially equal to the pressure outside the beverage container such that the user may easily detect that the pressure-relief device 16 has been activated.

Figure 3A:
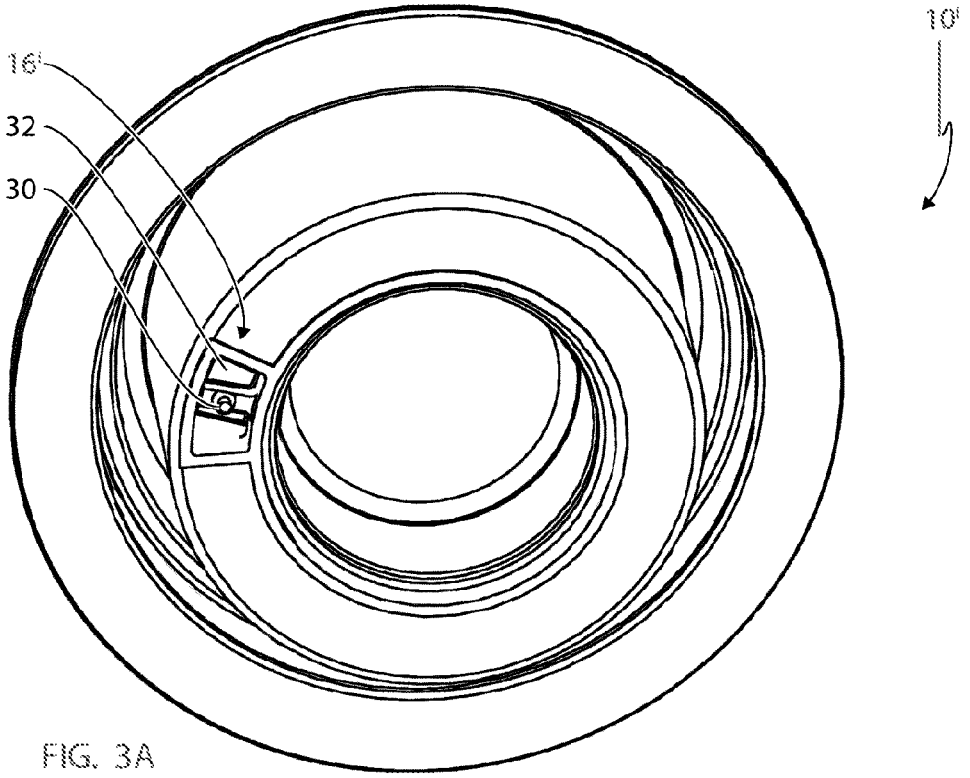
FIG. 3A is a closure having a pressure-relief device having a piercing mechanism

FIG. 3A shows a perspective view of a closure $\mathbf{10^I}$ having a pressure-relief device $\mathbf{16^I}$. The pressure-relief device $\mathbf{16^I}$ is located on the closure disc 12 and has a piercing mechanism 30 located such that its intended position is facing the interior of the beverage container. The piercing mechanism 30 is surrounded by an aperture 32 through the closure disc 12.

Figure 3B:
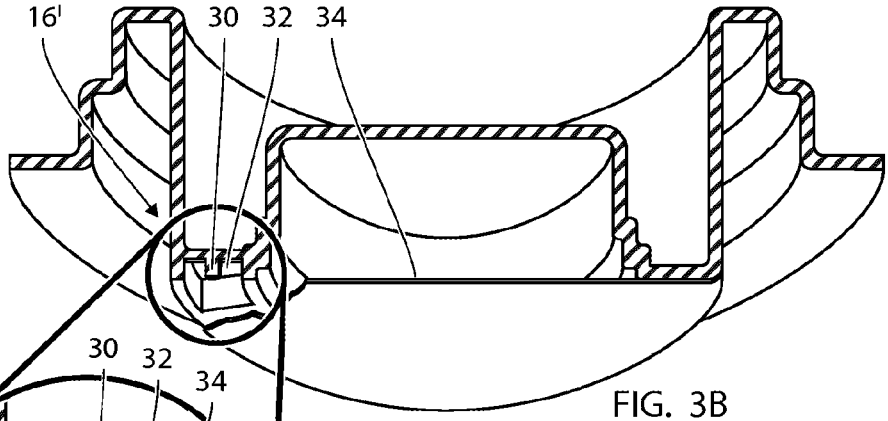
FIG. 3B is a side view of the pressure-relief device having a piercing mechanism

FIG. 3B shows a side perspective view of the pressure-relief device $\mathbf{16^I}$ having a piercing mechanism 30. The piercing mechanism 30 and the aperture 32 are covered by a flexible but breakable foil 34 on the side facing the interior of the beverage container. The foil 34 may be made of e.g. metal such as aluminum or polymeric material such as plastic.

Figure 3C:
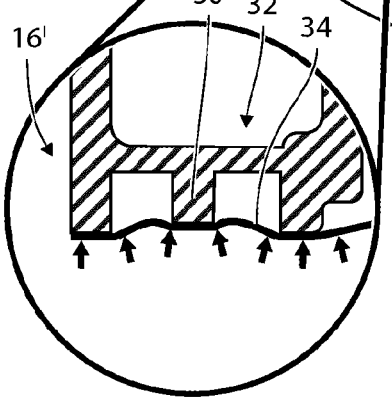
FIG. 3C is a close-up of the pressure-relief device when under pressure

FIG. 3C shows a close-up of the pressure-relief device $\mathbf{16^I}$ when closed under pressure as shown by the arrows. The flexible foil 34 is covering the aperture 32 preventing any gas from escaping. When the pressure is increasing inside the beverage container, the flexible foil 34 bulges towards the piercing mechanism 30.

Figure 3D:
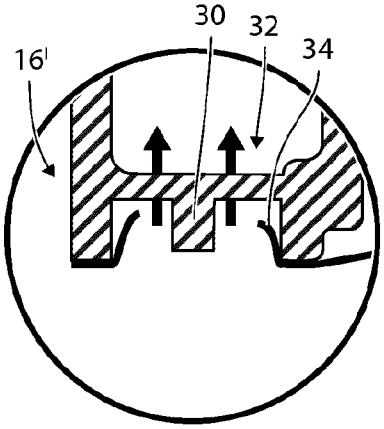
FIG. 3D is a close-up of the pressure-relief device when open

FIG. 3D shows a close-up of the pressure-relief device $\mathbf{16^I}$ when open. When the internal pressure of the beverage container exceeds the predetermined pressure value, the pressure force will cause the foil 34 to bulge further towards the piercing mechanism 30 and the foil 34 will break by being pierced by the piercing mechanism 30, establishing a permanent opening allowing gas to flow through as shown by the arrows.

Figure 3E:
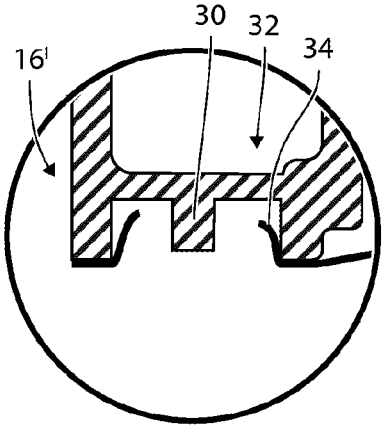
FIG. 3E is a close-up of the pressure-relief device when open

FIG. 3E shows a close-up of the pressure-relief device $\mathbf{16^I}$ when open. Since the foil 34 is broken, the opening is permanent and remains event when the gas has escaped.

Figure 4A:
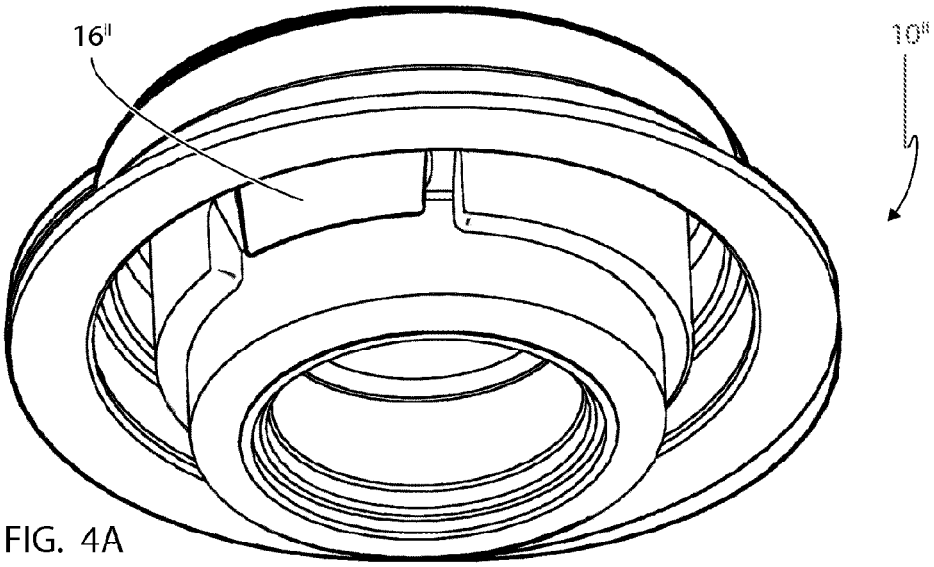
FIG. 4A is a closure having a pressure-relief device comprising a weakened part

FIG. 4A shows a closure $\mathbf{10^{II}}$ having a pressure-relief device $\mathbf{16^{II}}$ comprising a weakened part (not shown). The weakened part is located on the inner cylindrical part 20 and extends over a part of the circumference of the closure $\mathbf{10^{II}}$.

Figure 4B:
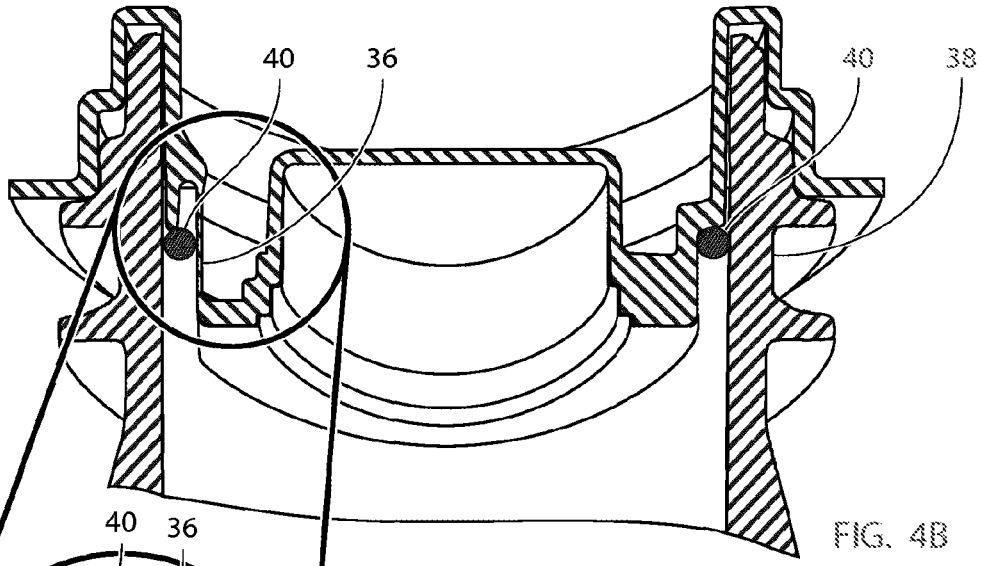
FIG. 4B is a side view of the pressure-relief device comprising a weakened part

FIG. 4B shows a side view of the pressure-relief device $\mathbf{16^{II}}$ comprising the weakened part 36. The neck part 38 of the beverage container and the sealing ring 40, made of elastic material, have been illustrated as well. The sealing ring 40 seals between the inner cylindrical part 20 of the closure $\mathbf{10^{II}}$ and the neck part 38 of the beverage container.

Figure 4C:
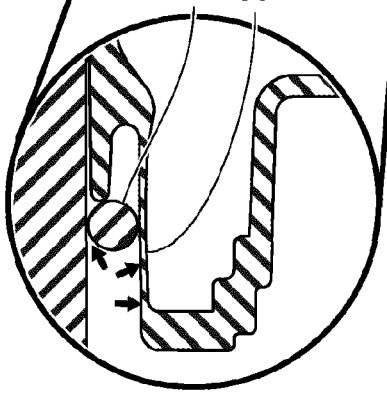
FIG. 4C is a close-up of the pressure-relief device when under pressure

FIG. 4C shows a close-up of the pressure-relief device $\mathbf{16^{II}}$ when closed and the pressure difference between the inside and the outside of the beverage container being lower than the predetermined pressure value. It can be seen that the sealing ring 40 seals between the weakened part 36 of the inner cylindrical part 20 of the closure $\mathbf{10^{II}}$ and the neck part 38 of the beverage container. The weakened part 36 resists the pressure force.

Figure 4D:
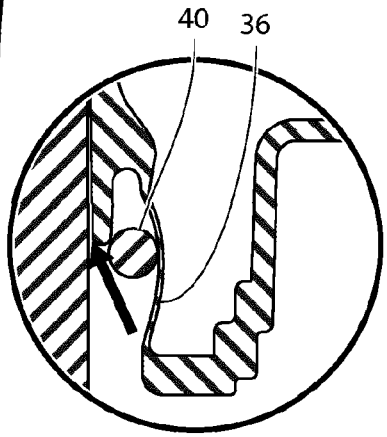
FIG. 4D is a close-up of the pressure-relief device when open

FIG. 4D shows a close-up of the pressure-relief device $\mathbf{16^{II}}$ when the pressure difference between the inside and the outside of the beverage container exceeds the predetermined pressure value. The pressure force will act on the weakened part 36 as shown by the arrows, causing the weakened part 36 to deform into an inwardly oriented bulge. The sealing ring will displace inwardly into the bulge and an opening will be established between the inner cylindrical part 20 and the neck part 38, allowing gas to escape.

Figure 4E:
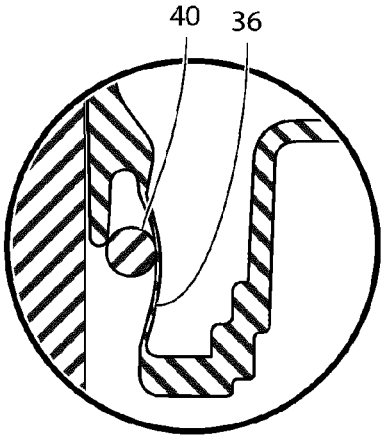
FIG. 4E is a close-up of the pressure-relief device when open

FIG. 4E shows a close-up of the pressure-relief device $\mathbf{16^{II}}$ when the pressure difference between the inside and the outside of the beverage container has been equalized. As the deformation causing the bulge is a plastic deformation of a substantially rigid plastic part, the bulge will to a substantial extent remain even after the pressure difference has been equalized, making it easy for the user to detect that the pressure-relief device 16$^{II}$ has been activated. According to an alternative embodiment, the deformation is substantially elastic and the bulge will disappear, again resuming the state of FIG. 4C, causing the sealing ring 40 to seal between the weakened part 36 of the inner cylindrical part 20 of the closure 10$^{II}$ and the neck part 38 of the beverage container.

Figure 5A:
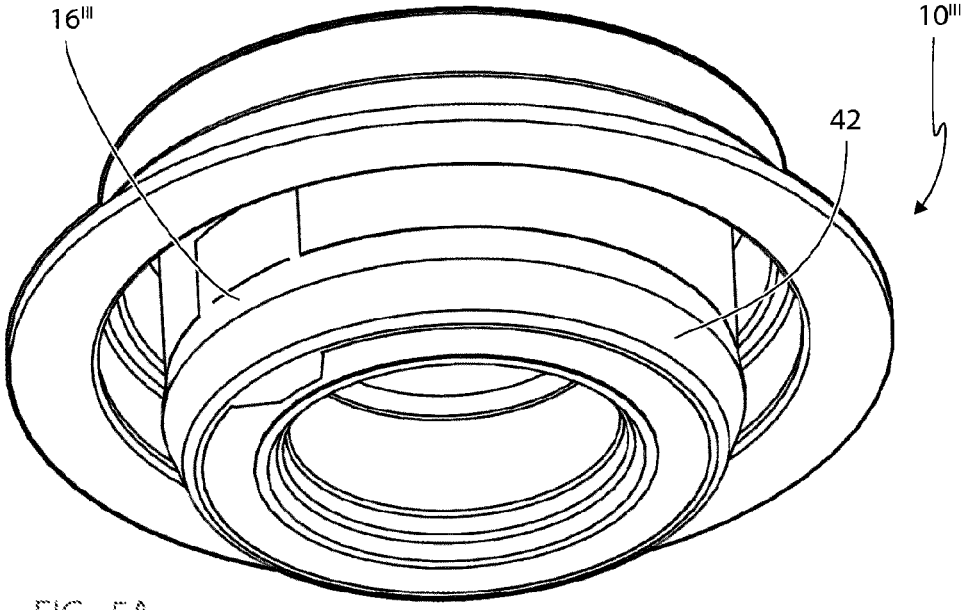
FIG. 5A is a closure having a sealing ring with an integrated weakened part

FIG. 5A shows a closure 10$^{III}$ having a sealing ring with an integrated weakened part 42. The pressure-relief device 16$^{III}$ is thus integrated into the sealing ring 42.

Figure 5B:
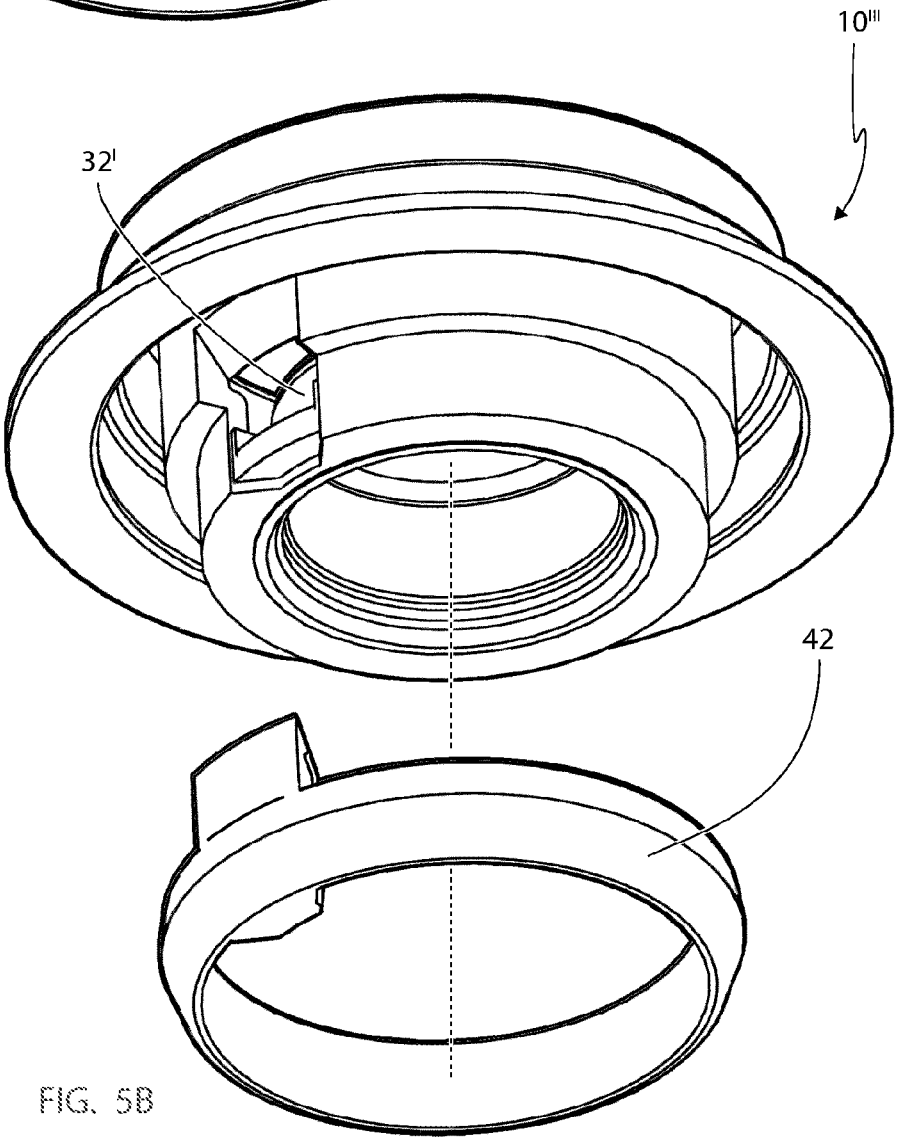
FIG. 5B is a perspective view of the sealing ring and the closure

FIG. 5B shows a perspective view of the sealing ring 42 and the closure 10$^{III}$ when disassembled. The part of the sealing ring 42 forming the pressure-relief device 16$^{III}$ is an extension of the sealing ring 42, which covers an aperture 32$^{I}$.

Figures 5C, 5D, 5E, 5F:
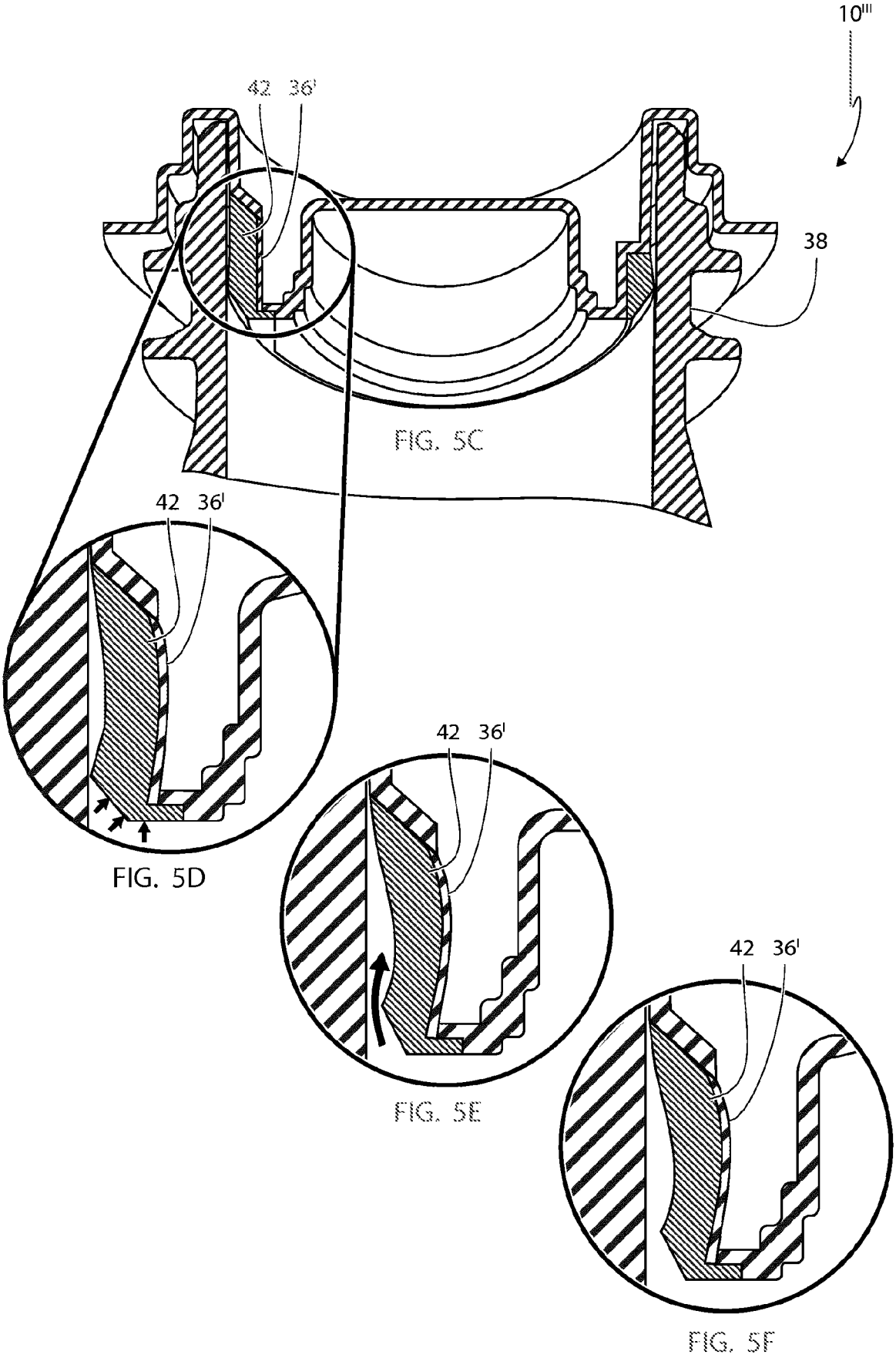
FIG. 5C is a side view of the closure including the pressure-relief device
FIG. 5D is a close-up of the pressure-relief device when under pressure
FIG. 5E is a close-up of the pressure-relief device when open
FIG. 5F is a close-up of the pressure-relief device when open

FIG. 5C shows a side view of the closure 10$^{III}$ including the pressure-relief device 16$^{III}$. It can be seen that the sealing ring 40 seals between the inner cylindrical part 20 of the closure 10$^{III}$ and the neck part 38 of the beverage container.

FIG. 5D shows a close-up of the pressure-relief device 16$^{III}$ when closed. It can be seen that the sealing ring 42 at the location of the pressure-relief device 16$^{III}$ is made up of a actual sealing ring 40$^{I}$ made of elastic material such as rubber and a weakened part 36 made of rigid plastic and inherently joined to the actual sealing ring 40$^{I}$ at the location of the pressure-relief device 16$^{III}$ blocking and sealing the aperture. The pressure force acts with an inward angle as shown by the arrows.

FIG. 5E shows a close-up of the pressure-relief device when under pressure and open and the difference between the inside and the outside of the beverage container exceeds the predetermined pressure value. The pressure force will act on the weakened part 36$^{I}$ of the sealing ring 42 as shown by the arrows, causing the weakened part 36$^{I}$ to deform into an inwardly oriented bulge. The sealing ring 42 as a whole at the location of the pressure-relief device 16$^{III}$ and aperture 32 will displace inwardly and an opening will be established between the inner cylindrical part 20 and the neck part 38, allowing gas to escape as shown by the arrow.

FIG. 5F shows a close-up of the pressure-relief device 16$^{III}$ when open and the difference between the inside and the outside of the beverage container has been equalized. As the deformation causing the bulge is a plastic deformation of a substantially rigid plastic part, the bulge will to a substantial extent remain even after the pressure difference has been equalized, making it easy for the user to detect that the pressure-relief device 16$^{III}$ has been activated, similar to the previous embodiment. According to an alternative embodiment, the deformation is substantially elastic and the bulge will disappear, again resuming the state of FIG. 5C, causing the sealing ring 40 to seal between the weakened part 36 of the inner cylindrical part 20 of the closure 10I$^{II}$ and the neck part 38 of the beverage container.

Figure 6A:
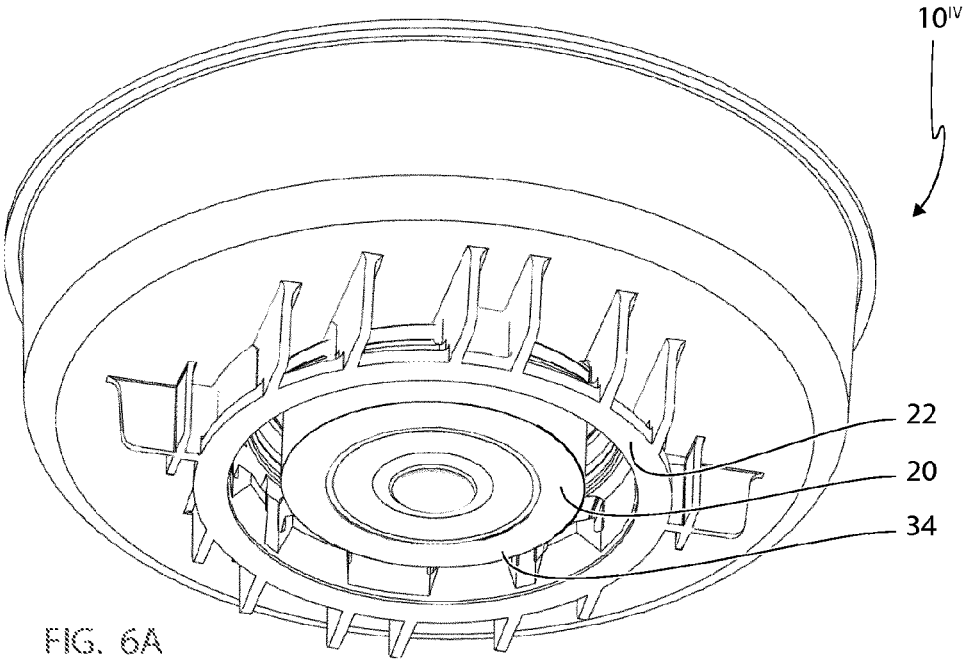
FIG. 6A is a closure having a ring-shaped pressure-relief device

FIG. 6A shows a closure 10$^{IV}$ having a flexible foil 34$^{I}$ forming part of a pressure-relief device 16$^{IV}$. The flexible foil 34 covers the area of the closure 10$^{IV}$ including the inner cylindrical flange facing the headspace of the beverage container (not shown). Further, the beverage outlet (not shown) is covered by the flexible foil 34 and is broken when the beverage container is installed in the beverage dispensing system (not shown).

Figure 6B:
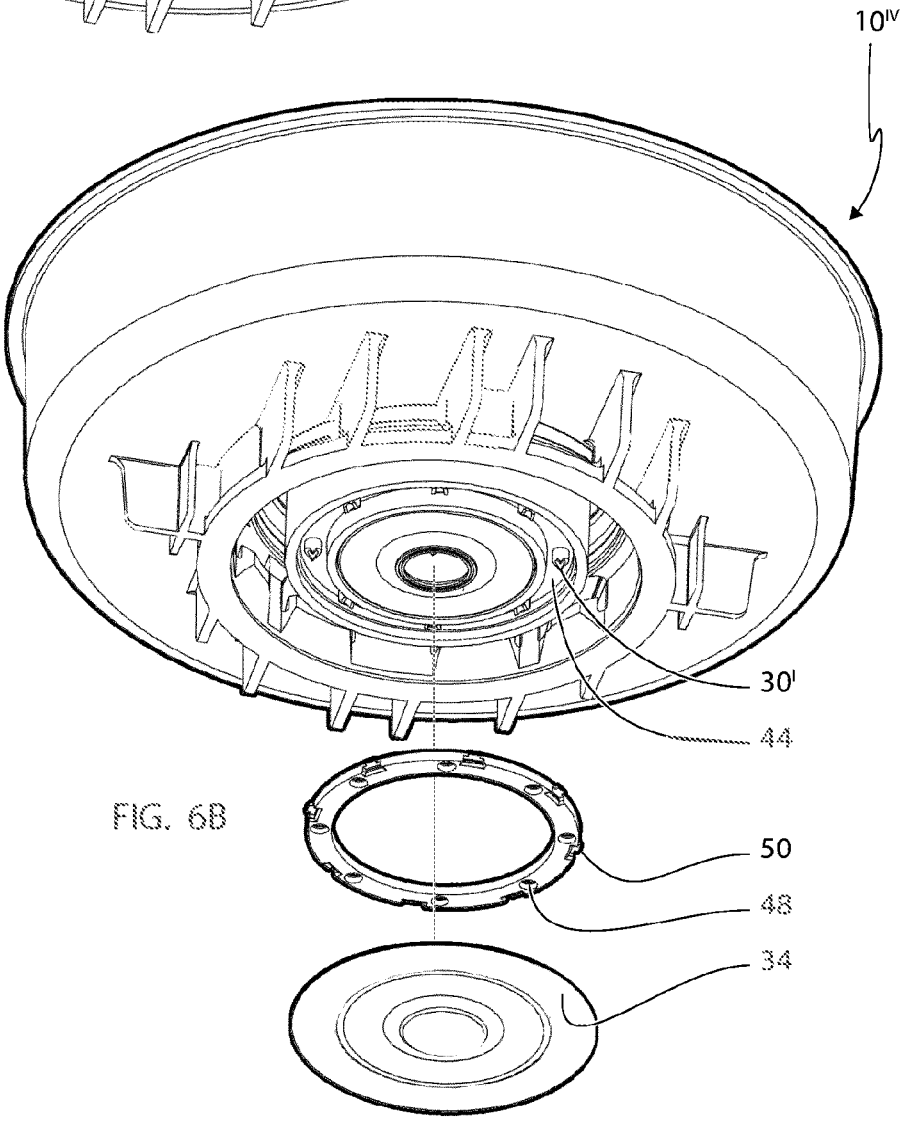
FIG. 6B is a perspective view showing the parts of the pressure-relief device

FIG. 6B shows a perspective view of the closure 10$^{IV}$ and the parts of the pressure-relief device 16$^{IX}$. The pressure-relief device 16$^{IV}$ of the closure 10$^{IV}$ comprises multiple hollow piercing mechanisms 30$^{I}$ inside a ring-shaped cavity 44 at the inner cylindrical flange 20. The pressure-relief device 16$^{IV}$ of the closure 10$^{IV}$ further comprises a ring-shaped spacer 46 of rigid plastic for being placed in the ring-shaped cavity 44. The ring-shaped spacer 46 including multiple holes 48 corresponding to the hollow piercing mechanisms 30$^{I}$. The ring-shaped spacer 42 further comprises tabs 50 for interacting with the inner cylindrical flange (inner cylindrical part) 20 for ensuring that a distance exists between bottom of the cavity 44 42 and the ring-shaped spacer 46. Both the cavity 44 and the ring-shaped spacer 46 are covered by the flexible foil 34$^{I}$.

Figure 6C:
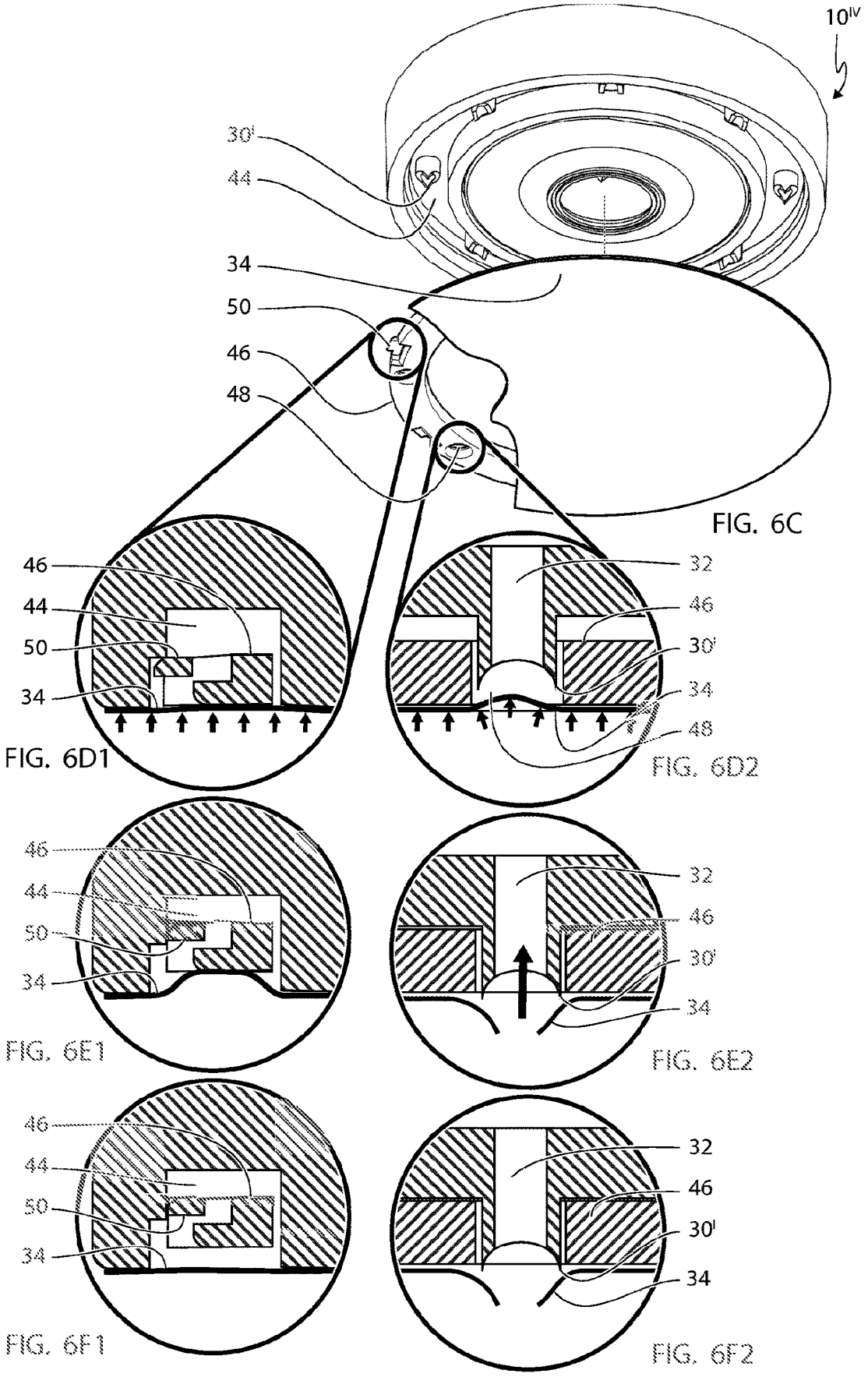
FIG. 6C is a view of the foil, ring-shaped piercer and ring-shaped spacer

FIG. 6C shows a view of the foil 34$^{I}$, the piercing mechanisms 30$^{I}$ and the ring-shaped spacer 46. The holes 48 of the ring-shaped spacer 46 prevent the piercing mechanisms 30$^{I}$ from piercing the foil 34.

FIGS. 6D1 & 6D2 show a close-up of the pressure-relief device 16$^{IV}$ when closed and under pressure as indicated by the arrows. The tabs 50 ensure that distance is maintained between the bottom of the cavity and the ring-shaped spacer 46, preventing contact between the foil 34$^{I}$ and the hollow piercing mechanisms 30$^{I}$. The pressure acts on the foil 32$^{I}$ and the foil 34$^{I}$ in turn rests on the ring-shaped spacer 46. The distance between the ring-shaped spacer 46 and the bottom of the cavity 44 is maintained by the tabs 50, which interlock with the inner cylindrical flange 20 and thereby prevent the foil 34$^{I}$ from being broken by the hollow piercing mechanisms 30$^{I}$.

FIGS. 6E1 & 6E2 show a close-up of the pressure-relief device 16$^{IV}$ when open. Once the pressure in the container exceeds the predetermined pressure value, the tabs 50 break or bend such that the ring-shaped spacer 46 moves towards the bottom of the cavity 44, eliminating the distance between them and exposing the hollow piercing mechanisms 30$^{I}$ through the holes 48. The hollow piercing mechanisms 30$^{I}$ may thus break the foil 34$^{I}$ and the gas within the container may escape through the hollow piercing mechanisms 30$^{I}$ and the aperture (not shown) of the closure 16$^{IX}$.

FIGS. 6F1 & 6F2 show a close-up of the pressure-relief device 16$^{IV}$ when open. As the foil 34 is broken, the opening is permanent.

Figures 7A, 7B, 7C, 7D, 7E:
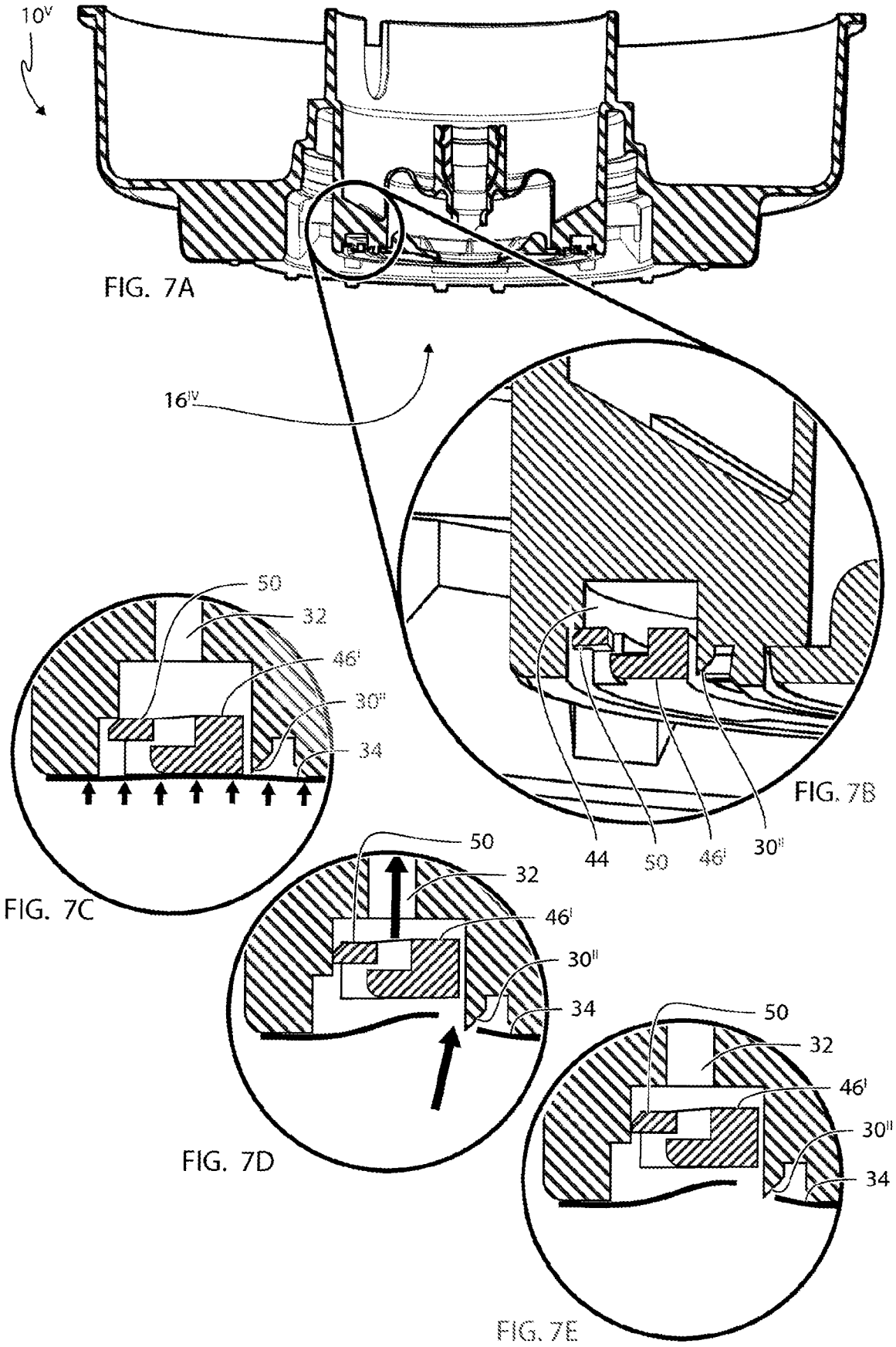
FIG. 7A is a side view of the closure including the pressure-relief device
FIG. 7B is a close-up of the closure including the pressure-relief device
FIG. 7C is a close-up of the pressure-relief device when under pressure
FIG. 7D is a close-up of the pressure-relief device when open
FIG. 7E is a close-up of the pressure-relief device when open

FIG. 7A shows a closure 10$^{V}$ similar to the previous embodiment having a flexible foil 34 forming part of a pressure-relief device 16$^{V}$. The flexible foil 34 covers the area of the closure 10$^{V}$ including the inner cylindrical flange 20 facing the headspace of the beverage container (not shown). Further, the beverage outlet is covered by the flexible foil 34 and is broken when the beverage container is installed in the beverage dispensing system (not shown).

FIG. 7B shows a close-up of the closure 10$^{V}$ including the pressure-relief device 16$^{V}$.

The ring-shaped spacer 46$^{I}$ is held in place by the tabs 50. The piercing mechanism 30$^{II}$ is placed adjacent the ring-shaped spacer 46$^{I}$. The pressure-relief device 16$^{V}$ of the closure 10$^{V}$ comprises one or more apertures 32 and a ring-shaped spacer 46$^{I}$ of rigid plastic for being placed in the ring-shaped cavity 44 at the inner cylindrical flange 20. The ring-shaped spacer 46$^{I}$ does not comprise any holes and is thus completely flat, however, it does comprise tabs 50 for interacting with the inner cylindrical flange 20 for ensuring that a distance exists between the ring-shaped spacer 46 and piercing mechanisms 30$^{II}$ forming part of the inner cylindrical flange. Both the piercing mechanisms 30$^{II}$ and the ring-shaped spacer 46 are covered by the flexible foil 34. The piercing mechanisms 30$^{II}$ are completely integrated into the closure 10$^{IV}$, and their number may range from one and upwards.

FIG. 7C shows a close-up of the pressure-relief device 16$^{V}$ when closed and when under pressure as indicated by the arrows. The tabs 50, which interlock with the inner cylindrical flange 20, ensure that distance is maintained between the foil 34 and the piercing mechanisms $\mathbf{30}^{II}$, preventing contact between them. The pressure acts on the foil 34 and the foil $\mathbf{34}^{I}$ in turn rests on the ring-shaped spacer 46. The tabs 50, thereby preventing the foil 34 from being broken by the piercing mechanisms 30II, maintain the distance between the foil 34 and the piercing mechanisms $\mathbf{30}^{II}$.

FIG. 7D shows a close-up of the pressure-relief device $\mathbf{16}^{V}$ when open. Once the pressure in the container exceeds the predetermined pressure value, the tabs 50 break or bend such that the ring-shaped spacer $\mathbf{46}^{I}$ moves further into the cavity 44 and in this way, the foil 34 is no longer supported by the ring-shaped spacer 46. The hollow piercing mechanisms $\mathbf{30}^{II}$ may thus break the foil 34 and the gas within the container may escape through the broken foil 34 and the aperture (not shown) of the closure $\mathbf{16}^{V}$.

FIG. 7E shows a close-up of the pressure-relief device $\mathbf{16}^{V}$ when open. Similar to the previous embodiment the pressure-relief device $\mathbf{16}^{V}$ stays open when the foil 34 has been broken.

Figures 8A, 8B, 8C, 8D:
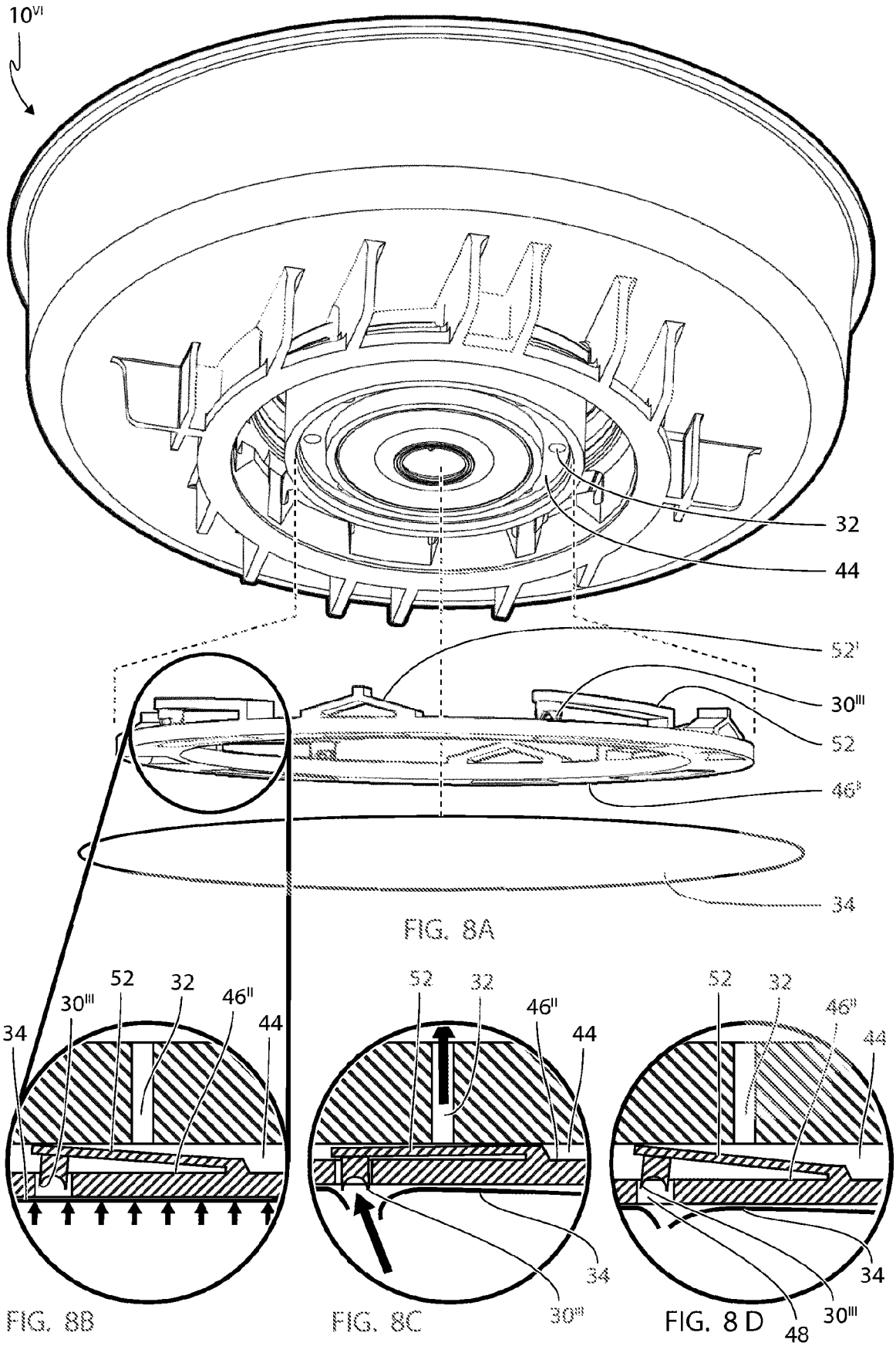
FIG. 8A is a closure having a flexible foil and a movable plate including a piercer
FIG. 8B is a perspective view showing the movable plate including the piercer
FIG. 8C is a close-up of the pressure-relief device when under pressure
FIG. 8D is a close-up of the pressure-relief device when open

FIG. 8A shows a closure $\mathbf{10}^{VI}$ similar to the previous embodiment having a flexible foil 34 forming part of a pressure-relief device $\mathbf{16}^{VI}$. The flexible foil 34 covers the area of the closure $\mathbf{10}^{VI}$ including the inner cylindrical flange 20 facing the headspace of the beverage container (not shown). Further, the beverage outlet (not shown) is covered by the flexible foil 34 and is broken when the beverage container is installed in the beverage dispensing system (not shown).

The pressure-relief device $\mathbf{16}^{VI}$ of the closure $\mathbf{10}^{VI}$ comprises one or more apertures 32 and a ring-shaped spacer $\mathbf{46}^{II}$ of rigid plastic for being placed in the ring-shaped cavity 44 at the inner cylindrical flange 20. The ring-shaped spacer $\mathbf{46}^{II}$ does not comprise any tabs; however, it does comprise holes 48 for the passage of air. The ring-shaped spacer $\mathbf{46}^{II}$ further comprises flexible arms 52 extending into the cavity 44 and including piercing mechanisms $\mathbf{30}^{II}$ located opposite the holes 48. The arms 52 ensure that a distance exists between the foil 34 and piercing mechanisms $\mathbf{30}^{III}$.

The ring-shaped spacer $\mathbf{46}^{II}$ comprises the flexible arms 52 connected at one end to the actual ring-shaped spacer $\mathbf{46}^{II}$ and at a distant end to a piercing mechanism $\mathbf{30}^{III}$. Each of the piercing mechanisms $\mathbf{30}^{III}$ is located at a hole 48 and is capable of flexing through the hole due to the flexible arm 52. Further, optional auxiliary arms $\mathbf{52}^{I}$ may be provided for obtaining additional support.

FIG. 8B shows a close-up of the pressure-relief device $\mathbf{16}^{VI}$ when closed and when under pressure as indicated by the arrows. The ring-shaped spacer $\mathbf{46}^{II}$ including the flexible arms 52 and the piercing mechanism $\mathbf{30}^{III}$ is contained within the cavity 44, and covered by the foil 34. The ring-shaped spacer $\mathbf{46}^{II}$ prevents contact between the foil 34 and the piercing mechanism $\mathbf{30}^{III}$. The pressure acts on the foil 34 and the foil 34 in turn rests on the ring-shaped spacer $\mathbf{46}^{II}$. The flexible arms 52 of the ring-shaped spacer $\mathbf{46}^{II}$ rest on the closure $\mathbf{10}^{VI}$ within the cavity 44 and will flex when subjected to a force, however, as long as the pressure inside the container does not exceed the predetermined pressure, the force will not be sufficient for allowing the piercing mechanisms $\mathbf{30}^{III}$ to be exposed through the hole 48 and the foil 34 is prevented from being broken by the piercing mechanisms $\mathbf{30}^{II}$.

FIG. 8C shows a close-up of the pressure-relief device $\mathbf{16}^{VI}$ when open. Once the pressure in the container exceeds the predetermined pressure value, the flexible arms 52 of the ring-shaped spacer $\mathbf{46}^{II}$ will flex or bend sufficiently for allowing the piercing mechanisms $\mathbf{30}^{III}$ to be exposed through the hole 48 and the foil 34 and in this way, the foil 34 is no longer supported by the ring-shaped spacer $\mathbf{46}^{II}$ and the piercing mechanisms $\mathbf{30}^{II}$ may thus break the foil 34 and the gas within the container may escape through the broken foil 34 and the aperture 32 of the pressure-relief device $\mathbf{16}^{VI}$.

FIG. 8D shows a close-up of the pressure-relief device $\mathbf{16}^{VI}$ when open. Similar to the previous embodiment the pressure-relief device $\mathbf{16}^{VI}$ stays open when the foil 34 has been broken.

Figure 9A:
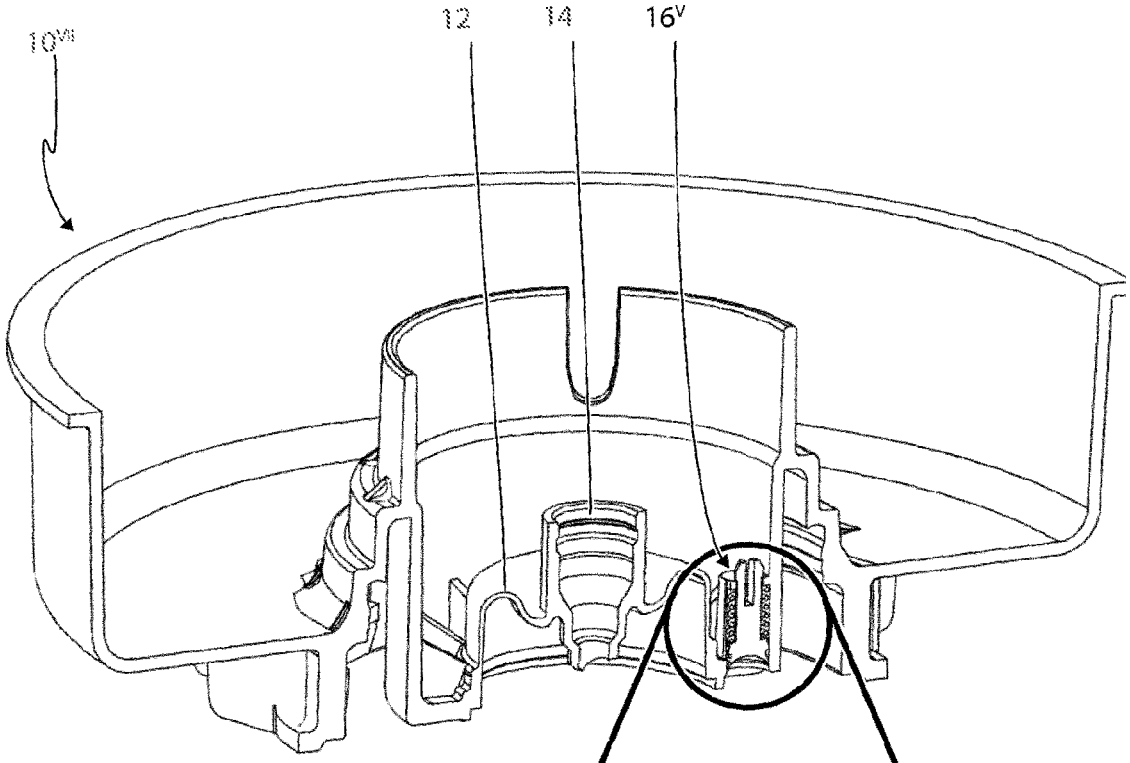
FIG. 9A is a perspective view of a closure according to another alternative embodiment

FIG. 9A shows a closure $\mathbf{10}^{VII}$ according to another alternative embodiment. The closure $\mathbf{10}^{VII}$ comprises a closure disc 12 including a centrally located beverage outlet 14 similar to the previous embodiments. The closure disc 12 further comprises a pressure-relief device $\mathbf{16}^{V}$ in the form of a spring-loaded overpressure valve 54 located at the closure disc 12 and extending through the closure disc 12.

Figure 9B:
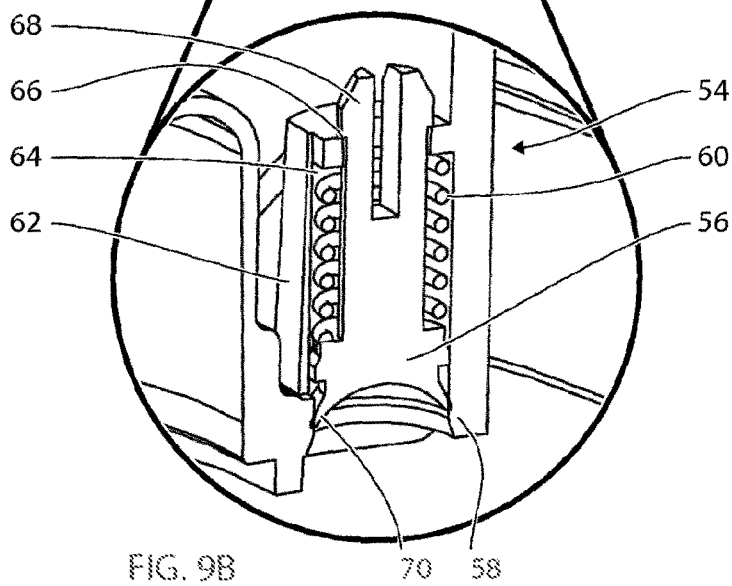
FIG. 9B is a close-up of a spring-loaded overpressure valve

FIG. 9B shows a close-up of the spring loaded overpressure valve 54. The spring loaded overpressure valve 54 comprises a valve body 56, which is spring loaded against a valve seat 58 by means of a spring 60. The valve body 56 and the spring 60 is located in a housing 62 extending away from the head space. The valve seat 58 is facing the head space of the beverage container.

In case the pressure inside the beverage container exceeds the predetermined pressure value, the valve body 56 is moved away from the valve seat as the spring is compressed until the valve body 56 exposes a slot 64 in the housing 62 allowing excessive gas to escape. The predetermined pressure value should as indicated above be chosen to be significantly higher than the internal carbonization pressure at room temperature but significantly lower than the burst pressure of the beverage container.

The housing 62 further comprises a guide hole 66 through which a guide part 68 of the valve body 56 extends. The guide hole 66 and the guide part 68 serve the purpose of keeping the valve body 56 aligned relative to the valve seat 58 and to prevent the valve body 56 from punching through the valve seat 58 due to the spring force applied to it. Optionally, the guide part 68 allows the valve body 56 to be manually operated from the outside. The valve body 56 has a rounded surface facing the head space and defines sealing lips 70, which seal against the valve seat 58. Preferably, polymeric materials are used, especially for the valve body 56 and the valve seat 58.

Figure 10A:
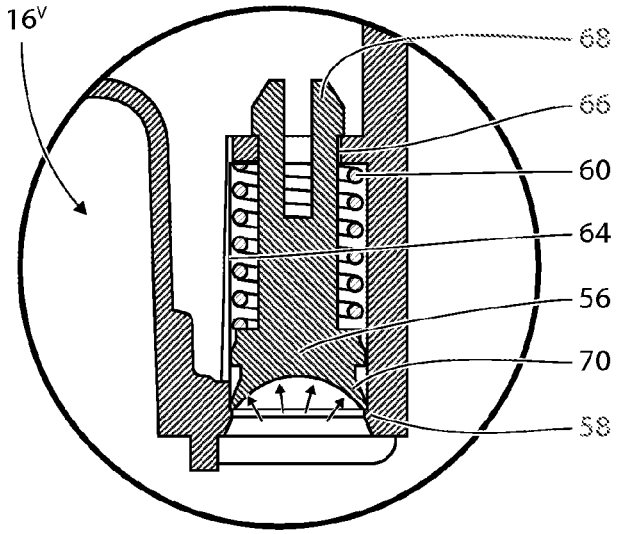
FIG. 10A is a side view of the spring-loaded overpressure valve in the closed state

FIG. 10A shows a close-up of the spring-loaded overpressure valve 54 ($\mathbf{16}^{V}$) in the closed state. The pressure inside the head space acts on the surface of the valve body 56 as indicated by the arrows. In normal operation, the carbonization pressure inside the head space cannot overcome the spring force of the spring 60 and thus a sealing relationship is maintained between the valve body 56 and the valve seat 58, preventing any gas from escaping the head space.

Figure 10B:
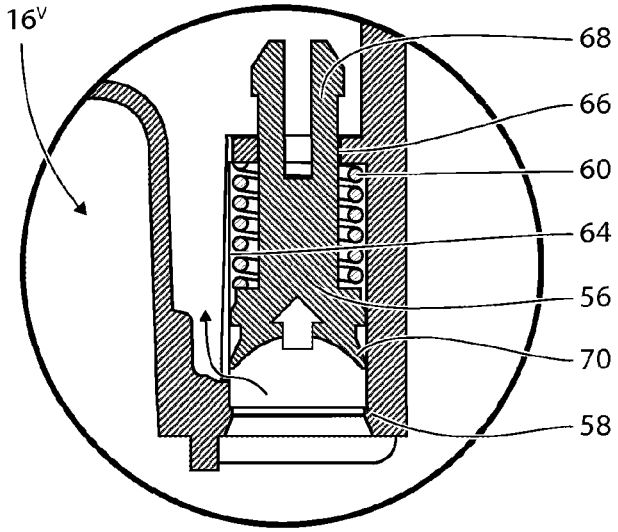
FIG. 10B is a side view of the spring-loaded overpressure valve in the open state

FIG. 10B shows a close-up of the spring-loaded overpressure valve 54 ($\mathbf{16}^{V}$) in the open state. When the pressure inside the head space is increased and exceeds the predetermined pressure value, the spring 60 is compressed allowing the valve body 56 to move away from the valve seat 60 as shown by the thick arrow, thereby exposing the slot 64 allowing excessive gas in the head space to escape as shown by the thin arrow. At the same time, the guide part 68 extends outwardly and optionally this movement of the guide part 68 may be used to indicate that the spring-loaded overpressure valve 54 has been activated by e.g. coupling it to a breakable part.

Figure 10C:
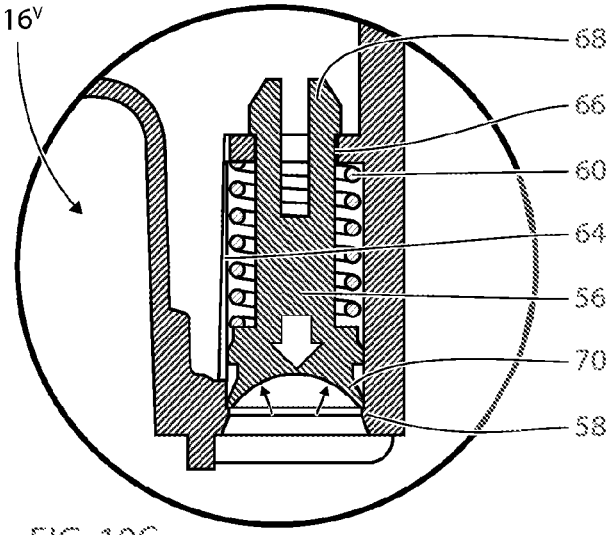
FIG. 10C is a side view of the spring-loaded overpressure valve in the reclosing state

FIG. 10C shows a close-up of the spring-loaded overpressure valve 54 (16$^{V}$) in the reclosing state. Normally, the spring 60 causes the valve body to move as shown by the thick arrow to its original position in contact with the valve seat 58 when the pressure in the head space returns below the predetermined pressure value, i.e. back to normal pressures, as shown by the thin arrows. Optionally, the open state may be maintained permanently even in case the pressure in the head space returns below the predetermined pressure value. This may be done by causing the guide part to stick in its outwardly extending position, e.g. by using a stopper part.

Figure 11:
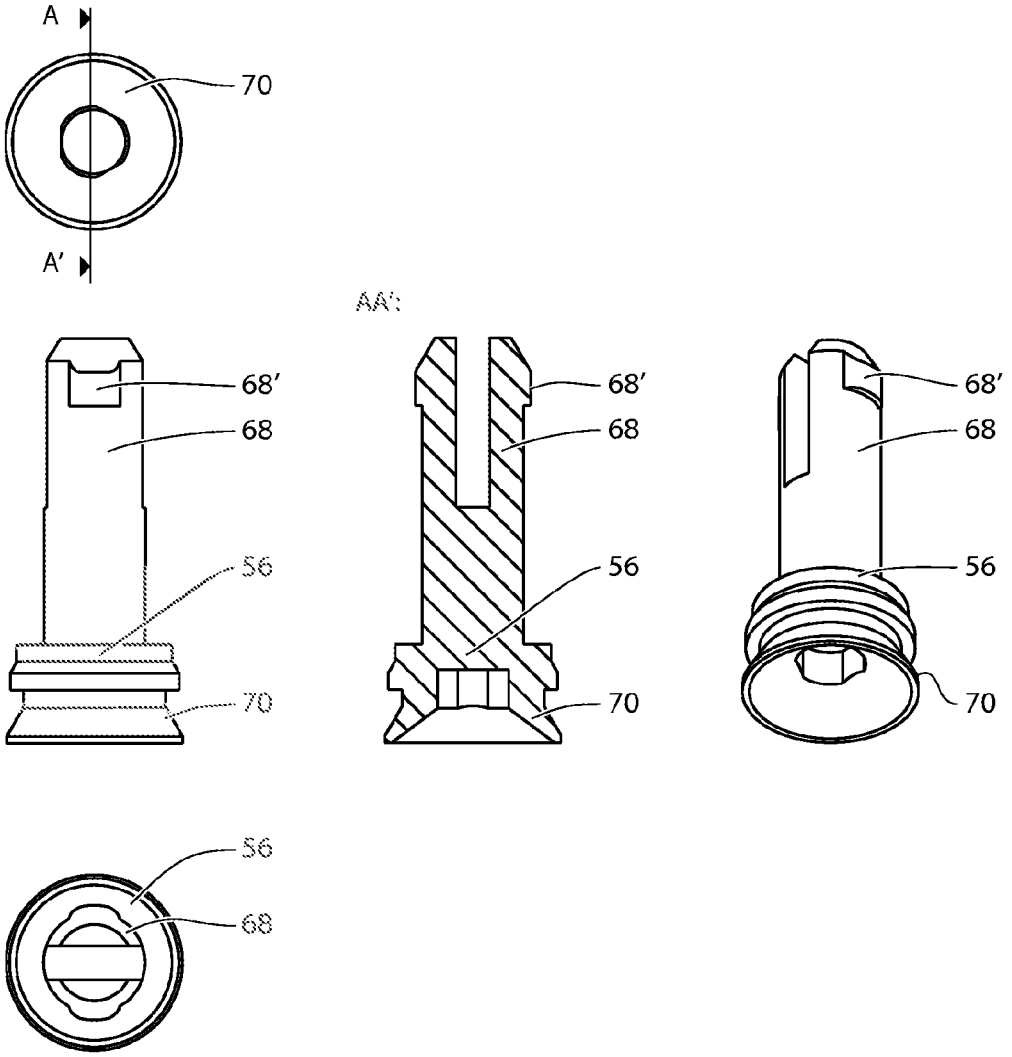
FIG. 11 is the valve body of the spring-loaded overpressure valve in different views

FIG. 11 shows the valve body 56 of the spring-loaded overpressure valve in different views, i.e. a top view, a perspective view, a side view, a cut-out view and a bottom view. The details are thereby clearly visible, such as the lips 70 for sealing against the valve seat 58 and the guide part 68. The guide part 68 includes a stopper 68', which is presently formed as a wedge and which acts to prevent the valve body 56 from being pushed through the valve seat 58. The guide part 68 is preferably split in two parts allowing some flexing in relation to each other for allowing the stopper to be easily introduced into the guide hole 66.

Figure 12:
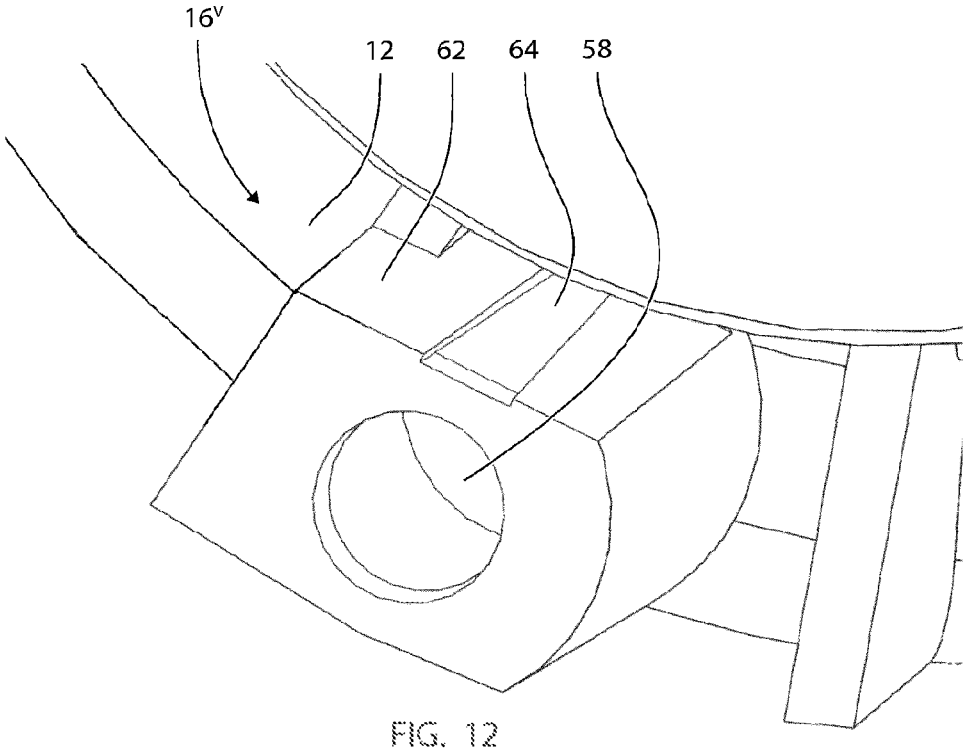
FIG. 12 is a perspective view of the housing of the spring-loaded overpressure valve

FIG. 12 shows the housing 62 of the spring-loaded overpressure valve 54 being a part of the closure disc 12. Clearly visible is the slot 64 extending as an opening along the side of the housing 62, as well as the guide hole 66.

Figure 13:
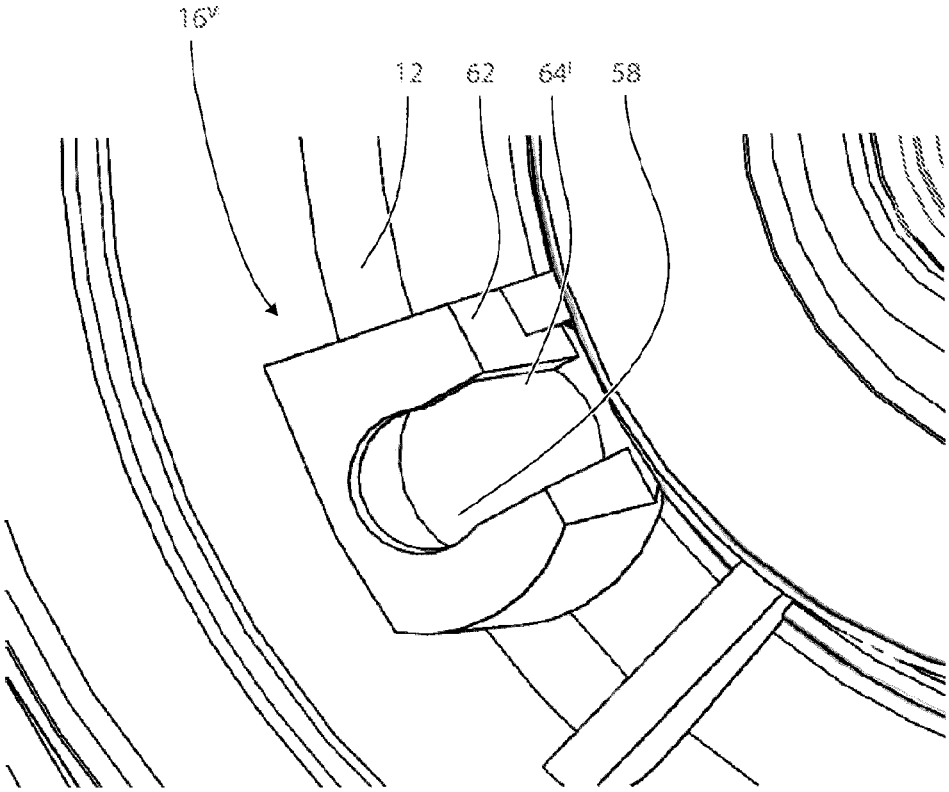
FIG. 13 is a perspective view of an alternative housing having a larger slot

FIG. 13 shows an alternative housing 62' having a larger slot 64' extending as an opening along the side of the housing 62'.

It is evident to the skillful individual that the above-described embodiments only describe one out of numerous embodiments envisaged according to the present invention and that the above embodiments may be modified in numerous ways without departing from the inventive idea as described by the appended claims.

PARTS WITH REFERENCE TO THE FIGURES

2. Closure (Prior art)
4. Neck part (Prior art)
6. Sealing ring (Prior art)
8. Groove (Prior art)
10. Closure
12. Closure disc
14. Beverage outlet
16. Pressure-relief device
18. Hollow protrusion
20. Inner cylindrical part
22. Outer cylindrical part
24. Auxiliary flanges
26. Wall parts
28. Predetermined breaking point
30. Piercer
32. Aperture
34. Flexible foil
36. Weakened part
38. Neck part
40. Sealing ring
42. Sealing ring (combined with wall part)
44. Cavity
46. Ring spacer
48. Holes
50. Tabs
52. Flexible arms
54. Spring-loaded overpressure valve
56. Valve body
58. Valve seat
60. Spring
62. Housing
64. Slot
66. Guide hole
68. Guide part
70. Lips

The invention claimed is:

1. A container assembly for accommodating a beverage, said container assembly comprising:

a collapsible beverage container having a body part defining an inner volume for accommodating said beverage and a cylindrical neck part defining an opening, an inwardly oriented surface and an outwardly oriented surface, said beverage container further defining a burst pressure, and a closure sealing off said opening of said cylindrical neck part and comprising a closure disc facing said inner volume of said collapsible beverage container, an inner cylindrical part facing said inwardly oriented surface of said cylindrical neck part and an outer cylindrical part facing said outwardly oriented surface of said cylindrical neck part, said closure disc comprising a beverage outlet for extracting said beverage from said beverage container, said closure further comprising a pressure-relief device located at said closure disc or said inner cylindrical part, said pressure-relief device being capable of establishing a permanent or reclosable opening through said closure or between said closure and said neck part for allowing a flow of fluid from said inner volume of said collapsible beverage container to an external space when a pressure difference between said inner volume and said external space exceeds a predetermined pressure value, said predetermined pressure value being lower than said burst pressure, wherein the pressure-relief device comprises a spring for biasing the pressure-relief device towards a closed state, wherein the spring is located outside of the inner volume.

2. The container assembly according to claim 1, wherein said pressure relief device being at least partially visible from outside said container assembly.

3. The container assembly according to claim 1, wherein said closure disc comprises a valve seat and said pressure-relief device comprises valve body urged against said valve seat by a spring.

4. The container assembly according to claim 3, wherein said pressure-relief device comprises a housing for accommodating said valve body and said spring, said housing preferably including a slot opening, said housing optionally including a guide hole for guiding a guide part of said valve body, said guide part optionally being flexible and optionally including a stopper.

5. The container assembly according to claim 1, wherein said beverage comprises dissolved $CO_2$ and/or $N_2$, said beverage establishing a temperature dependent pressurization inside said beverage container, said temperature dependent pressurization being lower than said burst pressure at room temperature.

6. The container assembly according to claim 1, wherein said predetermined pressure value is between 3 atm and 15 atm, preferably between 5 atm and 10 atm, more preferably between 7 atm and 8 atm.

7. A closure for a collapsible beverage container having a body part defining an inner volume for accommodating a beverage and a cylindrical neck part defining an opening, an inwardly oriented surface and an outwardly oriented surface, the closure configured for sealing off said opening of said cylindrical neck part, the closure defining an interior surface configured for facing the inner volume of the beverage container, and an exterior surface configured for facing an external space, the closure comprising a closure disc configured for facing said inner volume of said collapsible beverage container, an inner cylindrical part configured for facing said inwardly oriented surface of said cylindrical neck part and an outer cylindrical part configured for facing said outwardly oriented surface of said cylindrical neck part, said closure disc comprising a beverage outlet for extracting said beverage from said beverage container, said closure further comprising a pressure-relief device located at said closure disc or said inner cylindrical part, said pressure-relief device being capable of establishing a permanent or reclosable opening through said closure or configured for being capable of establishing a permanent or reclosable opening between said closure and said neck part for allowing a flow of fluid from said interior surface, through said opening, and to said exterior surface when a pressure difference between said interior surface and said exterior surface exceeds a predetermined pressure value, wherein the pressure-relief device comprises a spring for biasing the pressure-relief device towards a closed state, wherein the spring is located outside of the inner volume.

8. The closure according to claim 7, wherein the exterior surface has an auxiliary flange for protecting the beverage outlet.

9. The closure according to claim 7, wherein the exterior surface has an auxiliary flange surrounding the beverage outlet.

10. The container assembly according to claim 1, wherein the closure is permanently fastened to the neck part.

11. A closure for a collapsible beverage container having a body part defining an inner volume for accommodating a beverage and a cylindrical neck part defining an opening, an inwardly oriented surface and an outwardly oriented surface, the closure configured for sealing off said opening of said cylindrical neck part, the closure defining an interior surface configured for facing the inner volume of the beverage container, and an exterior surface configured for facing an external space, the closure comprising a closure disc configured for facing said inner volume of said collapsible beverage container, an inner cylindrical part configured for facing said inwardly oriented surface of said cylindrical neck part and an outer cylindrical part configured for facing said outwardly oriented surface of said cylindrical neck part, said closure disc comprising a beverage outlet for extracting said beverage from said beverage container, said closure further comprising a pressure-relief device located at said closure disc or said inner cylindrical part, said pressure-relief device being capable of establishing a permanent or reclosable opening through said closure or configured for being capable of establishing a permanent or reclosable opening between said closure and said neck part for allowing a flow of fluid from said interior surface, through said opening, and to said exterior surface when a pressure difference between said interior surface and said exterior surface exceeds a predetermined pressure value, wherein the pressure-relief device is located outside of the inner volume.

* * * * *